United States Patent [19]

Heath

[11] Patent Number: 4,579,565

[45] Date of Patent: Apr. 1, 1986

[54] METHODS AND APPARATUS FOR SEPARATING GASES AND LIQUIDS FROM NATURAL GAS WELLHEAD EFFLUENT

[76] Inventor: Rodney T. Heath, 4901 E. Main St., Farmington, N. Mex. 87401

[21] Appl. No.: 732,379

[22] Filed: May 8, 1985

Related U.S. Application Data

[63] Continuation-in-part of Ser. No. 537,298, Sep. 29, 1983, abandoned.

[51] Int. Cl.[4] ..... B01D 19/00; B01D 53/14

[52] U.S. Cl. ..... 55/20; 55/40; 55/44; 55/163; 55/174; 55/195; 55/32

[58] Field of Search ..... 55/20, 23, 24, 32, 38, 55/40, 42, 44, 45, 55, 171–177, 163, 189, 195

[56] References Cited

U.S. PATENT DOCUMENTS

| | | | |
|---|---|---|---|
| 2,690,814 | 10/1954 | Reid | 55/32 |
| 2,728,406 | 12/1955 | Maher | 55/42 |
| 2,765,045 | 10/1956 | Meyers | 55/174 X |
| 3,119,674 | 1/1964 | Glasgow et al. | 55/174 X |
| 3,331,188 | 7/1967 | Sinex | 55/174 X |

*Primary Examiner*—Charles Hart

*Attorney, Agent, or Firm*—Klaas & Law

[57] ABSTRACT

An apparatus and method for improving the volumetric yield of wellhead gas and the hydrocarbon composition of the liquid condensate from a natural gas well by the use of multiple stages of gas-liquid separation and gas compression including the use of heating means for heating the wellhead gas stream to a predetermined temperature; valve means associated with the heating means for reducing the pressure of the wellhead gas stream in the heating means to a predetermined reduced pressure to produce a reduced pressure and reduced temperature wellhead gas stream; mixing means for mixing the reduced pressure wellhead gas stream with compressed gases and vapors which have been subjected to multiple stages of compression; high pressure gas liquid separation means for separating gases from liquids in the heated, reduced pressure wellhead gas stream that have been mixed with compressed gases and vapors; second gas-liquid separation means operating at a lower pressure than the high pressure gas-liquid separation means for further separation of gases and vapors from the liquid separated by the high pressure gas-liquid separation means to produce flashed gases, vapors and liquid components; and gas compression means for compressing and liquifying the flashed components recovered from the second gas-liquid separation means and means for introducing the compressed flashed components into the reduced pressure wellhead gases in the mixing means.

36 Claims, 19 Drawing Figures

METHODS AND APPARATUS FOR SEPARATING GASES AND LIQUIDS FROM NATURAL GAS WELLHEAD EFFLUENT

This is a continuation-in-part of my copending U.S. patent application, Ser. No. 537,298 filed Sep. 29, 1983, and now abandoned for A Method And Apparatus For Separating Gases And Liquids From Well-Head Gases, the benefit of the filing date of which is claimed herein.

FIELD OF THE INVENTION

This invention relates to the separation of gases and vapors from the liquids present in the wellhead gas effluent from natural gas wells. In particular, this invention relates to a method and apparatus for improving the production of natural gas wells by the use of multiple stages of gas and vapor compression in a manner which can recover additional liquid hydrocarbons in more stable condition at controlled relatively low vapor pressure and enrich and increase the volume of the sales gas stream.

BACKGROUND OF THE INVENTION

Many natural gas wells produce a relatively high pressure well stream effluent containing significant volumes of high vapor pressure condensates which will normally contain absorbed and dissolved natural gas, propane, butane, pentane and the like. Currently these liquid and dissolved hydrocarbons are only partially recovered by conventional, high pressure, separator units. The liquid hydrocarbon by-products normally removed from the well stream by a high pressure separator unit, are collected and then typically dumped to a low pressure storage tank means for subsequent sale and use. A substantial amount of dissolved gas and high vapor pressure hydrocarbons remain in the liquid hydrocarbon by-products. Substantial amounts of these gases and hydrocarbons may vaporize by flashing in the storage tank due to the substantial reduction in pressure in the tank which permits the volatile components to evaporate or off-gas into gas and vapor collected in the storage tank over the condensate. In this manner, substantial amounts of gas and entrained liquid hydrocarbons are often vented to the atmosphere to reduce storage tank pressure and are wasted. In addition to this initial vaporization and loss, further evaporation occurs when the condensate stands for a period of time in the storage tank or when the condensate is subsequently transported to another location or during subsequent storage and/or processing. This is described in the industry as weathering. Many users of the condensate specify particular low vaporization pressure requirements for such condensate; and the salability and value of the condensate depends upon the characteristics of the condensate.

Thus, natural gas wells, which produce significant amounts of high vapor pressure condensates along with the natural gas, present a great opportunity for improvement in production methods including a reduction in discharge to the environment and economic gain by recovery of otherwise wasted by-products. As previously described, present production equipment waste to the atmosphere large quantities of recoverable liquid and gaseous hydrocarbons, including absorbed and dissolved natural gas components. This waste occurs when the high vapor pressure liquid condensates and the dissolved gases are removed from the flowing gas stream by the separator, and through valving and sometimes intermediate pressure vessels, flashed when the pressure on the condensates is reduced to approximately atmospheric in the storage tanks.

One prior method directed at reducing the loss of liquid hydrocarbon components, which would otherwise be lost from flashing, has involved the use of a staging flash separator where the pressure of the condensate is reduced in stages. For example, the condensate pressure could be reduced in stages before transfer to a storage tank maintained at about atmospheric pressure.

Staging, in the manner described, can increase the recovered hydrocarbons by as much as 10% to 15%, but staging alone does not remove all of the absorbed gases and volatile hydrocarbon vapors from the condensate. The resulting liquid condensate still contains important components which, as previously described, cannot be completely held in the liquid phase at atmospheric pressure and will still be carried into the gases and vapors during flashing with the attendant loss of heavier entrained liquid hydrocarbon components of the condensate.

Another prior art method and apparatus for attempting to increase recovery of condensible hydrocarbons involves the use of very low temperature systems of the type disclosed by Maher U.S. Pat. No. 2,728,406. Such low temperature methods and apparatus depend upon chilling of a gas stream through pressure reduction to very low temperatures below the freezing point of water. Satisfactory operation of such low temperature systems have required use of antifreeze solutions to prevent freezing of liquids in the processing system. Furthermore, low temperature separation units cause a shrinkage of the volume and a reduction in the BTU content of the saleable natural gas, and unless pressurized liquid storage facilities are used, a low temperature separation unit will, in many cases, result in less rather than more liquid hydrocarbon recovery. The present invention does not employ any low temperature process nor low temperature apparatus of the type described in U.S. Pat. No. 2,728,406. To the contrary, the present invention employs relatively high temperature processes and apparatus wherein, under normal operating conditions, the temperature of the fluids being processed never falls below the freezing point of water (e.g., approximately 32° F.) nor below gas hydrate formation temperatures of processed fluids.

It is, therefore, an objective of the present invention to provide an apparatus and method for more efficiently processing the additional recoverable gas and liquid hydrocarbon components normally contained in the condensates obtained from a natural gas wellhead gas-liquid separation system.

BRIEF SUMMARY OF THE INVENTION

The present invention provides an apparatus and method for enhancing the overall production of natural gas wells by the use of multiple stages of gas-liquid separation in a process wherein the pressure on the condensate is reduced in a manner that increases the recovery of absorbed gases and vapors before the transfer of the remaining liquid to a storage tank at nearly atmospheric pressure, and includes compressing the gases and vapors recovered from separation stages, and then reintroducing these recovered components back into the wellhead stream, under specific predetermined conditions, which also enhances the recovery of both lighter and heavier hydrocarbon components which might otherwise be wasted.

The present invention employs compressor means selected to receive and compress by-product gas from a stabilizer-stripper type second separator means provided in the system, and for subsequently injecting compressed gases and vapors into the wellhead gas stream at a predetermined location for recycling under conditions which facilitate enrichment of the volume, composition and B.T.U. content of the sales gas stream as well as liquid hydrocarbon recovery.

In one embodiment of the present invention, an intermediate staging separator may be employed which, in a preferred embodiment, may, in addition contain heat exchanger means whereby some of the heat of compression imparted to the compressed gases and vapors by the compressor means is used to maintain a predetermined temperature in the staging separator.

In a preferred embodiment of the present invention, the second separation means employed is a trayed stripping tower with reboiler means operated by a natural gas fired heater. The heat of compression can again be used to offset the heater gas usage. The use of the stripper and reboiler described allows the vapor pressure of the resulting condensate to be reduced to about atmospheric pressure thereby essentially eliminating all subsequent vapor and liquid loss from the condensate tank.

In general, the apparatus of the present invention enables processing of effluent from a natural gas wellhead as discharged at the wellhead site at wellhead discharge pressures and temperatures, the effluent constituents comprising light end and heavy end hydrocarbons and water in gaseous, liquid and vapor phases, to remove water and heavy end hydrocarbons from the effluent and to provide an increased volume of sales gas of increased BTU content containing primarily light end hydrocarbons in a stable gaseous phase and to provide heavy end hydrocarbons in a stable liquid phase without substantial loss of either of the light end hydrocarbons or the heavy end hydrocarbons during processing of the effluent. In one embodiment, the apparatus comprises first effluent heating means for heating the effluent to a predetermined, relatively high temperature; a choke means downstream of the first effluent heating means for receiving the heated effluent from the first effluent heating means and reducing the pressure of the heated effluent to a suitable predetermined processing pressure; and a second effluent heating means downstream of the choke means for increasing the temperature of the effluent to a predetermined suitable elevated processing temperature. A three phase high pressure primary separator means is located downstream of the second effluent heating means for continuously receiving the heated effluent from the second effluent heating means at a relatively high temperature above the gas hydrate formation temperature and for continuously separating the heated effluent into (1) a body of gaseous light end hydrocarbon constituents of sales gas quality and (2) into a liquid body of water constituents and (3) into a first body of residual hydrocarbon constituents including a minoral residual portion of the light end hydrocarbon components and a majoral residual portion of heavy end hydrocarbon components in liquid and vapor phases. A heat exchanger means is located downstream of the primary separator means for continuously receiving and heating residual hydrocarbon constituents exiting the primary separator means to increase the temperature thereof to a temperature in excess of the exit temperature. A stripper means is located downstream of the primary separator means and the heat exchanger means for continuously receiving the residual hydrocarbon constituents from the primary separator means at a relatively high temperature and a relatively high pressure and for causing separation of said residual hydrocarbon constituents into a second body of residual gaseous light end hydrocarbon components and a second body of residual heavy end hydrocarbon components. A gaseous discharge means is associated with the stripper means for continuously removing the second body of residual gaseous hydrocarbon constituents therefrom to form a gaseous recycle stream of hydrocarbons composed primarily of light end hydrocarbon constituents with a minority of heavy end hydrocarbon constituents therein and having a relatively high exit temperature. Liquid collection means are associated with the stripper means for continuously collecting the second body of residual liquid hydrocarbons and a reboiler heating means is associated with the liquid collection means for continuously heating the second body of residual liquid hydrocarbons to a relatively high temperature sufficient to continuously vaporize substantially all light end hydrocarbon constituents contained therein and to drive vaporized light end hydrocarbon constituents back through the stripper means to the gaseous discharge means associated therewith. A heavy end liquid discharge means is associated with the liquid collection means for continuously removing substantially only heavy end constituents in liquid phase therefrom at an elevated temperature and at an elevated pressure and through the heat exchanger is connected to heavy end liquid storage means maintained at substantially atmospheric temperature and pressure conditions for receiving the heavy end constituents in liquid phase from the heavy end liquid discharge means. Multistage compression means are located downstream of the gaseous discharge means for continuously receiving the second body of gaseous hydrocarbon constituents therefrom and for compressing gaseous hydrocarbon constituents to increase the entry pressure thereof. Forced draft atmospheric cooling and gaseous-liquid separation-trap means are located downstream of each stage of said compression means to further separate light end gaseous components from heavy end liquid components and a gaseous-discharge means is connected to the gaseous-liquid separation-trap means for returning gaseous light end hydrocarbon components to the system downstream of the choke means and upstream of the second heater means whereby the gaseous light end hydrocarbon components are mixed with the wellhead effluent for recycling therewith. The apparatus is constructed and arranged to continuously maintain temperatures of the wellhead effluent and constituents thereof processed during the processing cycle at elevated temperatures in excess of at least approximately 32° F. and gaseous hydrate temperatures.

In general, the methods of the present invention provide for continuous treatment of natural gas wellhead effluent at the wellhead for increasing the recovery of volume and BTU content of sales gas while increasing the volume and stability of hydrocarbon liquid condensate and reducing venting of gaseous constituents to the atmosphere by controlling the temperature and pressure of the wellhead effluent by heating to provide a controlled temperature and pressure processing stream of wellhead effluent having a temperature and pressure suitable for initial separation of gaseous and liquid constituents of the wellhead effluent. Primary separation is effected in a high pressure three phase separator apparatus to separate gaseous light end hydrocarbon constituents and liquid hydrocarbon condensate constituents and liquid water condensate constituents in the processing stream of natural gas wellhead effluent. The gaseous light end hydrocarbon constituents are removed from the high pressure separator apparatus to provide a stream of sales gas. Liquid hydrocarbon constituents are collected in the high pressure separator apparatus and continuously transferred to a stripper apparatus to cause secondary separation of gaseous hydrocarbon constituents from liquid hydrocarbon constituents and to provide a secondary stream of gaseous hydrocarbon constituents and a secondary body of liquid hydrocarbon constituents. The secondary body of liquid heavy end hydrocarbon constituents is continuously heated to further vaporize substantially all of the light end hydrocarbon constituents and cause the light end hydrocarbon constituents to flow upwardly through the stripper means and join the secondary stream of gaseous light end hydrocarbon constituents. The secondary stream of heated gaseous hydrocarbon constituents is continuously delivered to compressor-separator means to cause separation of gaseous light hydrocarbon ends from heavier re-condensed liquid hydrocarbon ends. Liquid hydrocarbon ends from the compressor-separator means are continuously recycled to the stripper means to continuously form and collect a body of heated liquid hydrocarbons which is at a predetermined temperature and pressure and is substantially free of light end hydrocarbons and which can be delivered to an atmospheric storage tank at a controlled relatively low vapor pressure without any substantial loss of hydrocarbons under atmospheric temperature and pressure conditions in the storage tank and to continuously form gaseous hydrocarbon ends which are returned to the compressor for further processing. Gaseous hydrocarbon constituents from the compressor-separator means are continuously returned to the high pressure separating means for further recycling therein with the controlled temperature and pressure processing stream of natural gas wellhead effluent to increase the BTU content and volume of sales gas.

BRIEF DESCRIPTION OF THE DRAWINGS

Presently preferred and illustrative embodiments of the invention are shown in the accompanying drawings wherein.

DETAILED DESCRIPTION OF THE INVENTION

Figure 1:
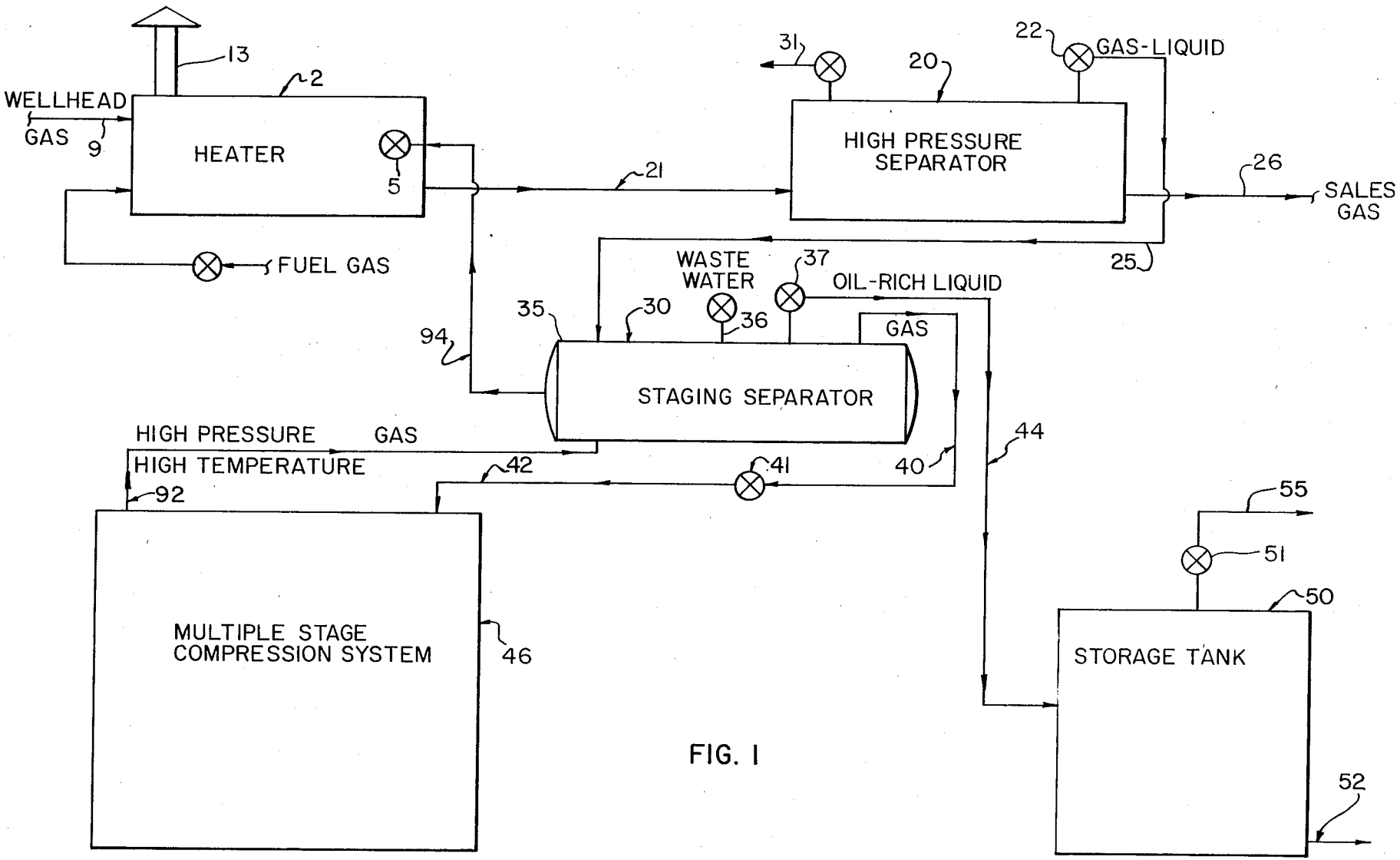
FIG. 1 is a schematic flow diagram of a method of the present invention for separating gases from the condensible liquids present in natural gas wellhead gases.

A gas-liquid separation apparatus and method of the present invention is shown schematically in FIG. 1. The wellhead gas (effluent) is heated, passed through a choke and then mixed with high pressure, high temperature recycle gas products which had previously undergone multiple stages of compression. The mixed gases are then subjected to high pressure gas-liquid separation to initially remove the liquid condensates and to produce an enriched sales gas that is suitable for further treatment such as dehydration if desirable before use. For example, a dehydrating system of the type shown in U.S. Pat. Nos. 4,342,572, issued Aug. 3, 1982; 4,198,214, issued Apr. 15, 1980; and 3,094,574, 3,288,448, 3,541,763, and co-pending application of Charles R. Gerlach et al., U.S. Ser. No. 277,266, the disclosures of which are incorporated herein by reference, can be employed in combination with the herein described invention.

Figure 2:
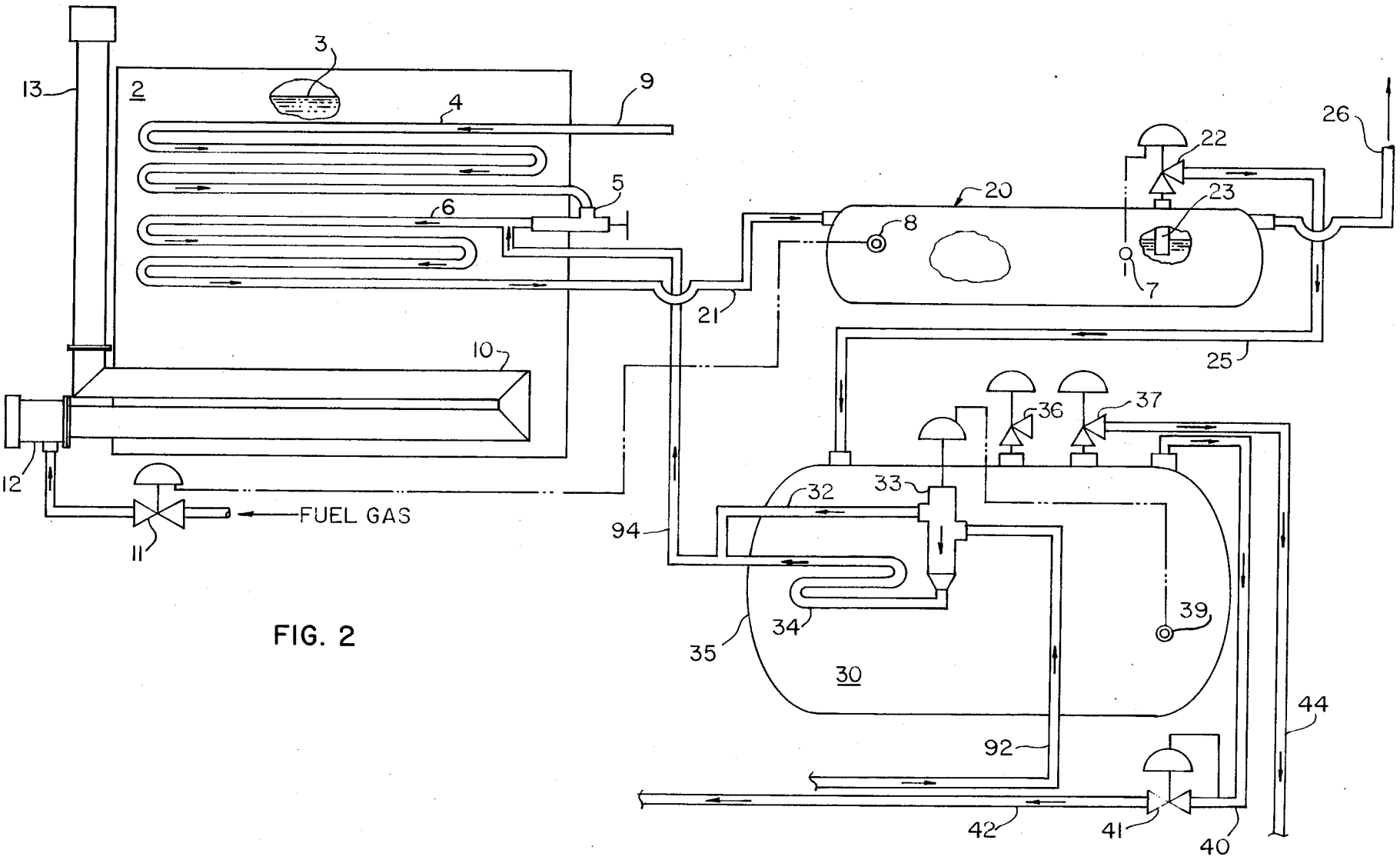
FIG. 2 is a partial flow diagram of the heater, high pressure separator, and staging separator apparatus used in a method of the present invention.

As shown in FIGS. 1 & 2, the gas-liquid separation apparatus and system of the present invention begins with a conventional heater means 2 having a heat exchanging tube coil means 4 into which the gaseous product from a wellhead are introduced from an inlet conduit 9. The wellhead gases are conveyed via interconnected gas heating coil means 4 and 6, which are immersed in an indirect heating medium 3, such as a glycol and water solution in heater 2. A pressure reducing choke valve means 5 is inserted in the pipe connecting gas heating coils 4 and 6, and is used to reduce the wellhead pressure to a pressure compatible with the operating pressure of a conventional three phase high pressure primary separator means 20 and the sales gas line 26. The heating medium 3 can be heated by means of a conventional fire tube heater shown at 10. The temperature of fire tube heater 10 is controlled by means of a thermostatically controlled gas supply valve 11 connected to a gas burner unit 12, and the heater 10 is connected to a flu 13.

Heating coil 6 is connected to high pressure separator 20 by means of a pipe 21. This high pressure separator 20 operates to mechanically separate gaseous and liquid components of the well stream at a predetermined elevated operating temperature and pressure as is well known in the art. Typically the gas-liquid mixture introduced into high pressure separator 20 will be at a pressure of from about 1,000 psig to about 400 psig and temperature of from about 70° F. (22° C.) to about 90° F. (33° C.). The valve 22 is controlled by the liquid level inside the high pressure separator 20 such that when the liquid level of the liquid hydrocarbons reaches a predetermined height, the valve 22 will be opened drawing off the liquid under the pressure of the gaseous component by means of pipe 25 which transmits the liquid component to another conventional separator means such as an intermediate pressure staging separator 30. The gaseous sales gas components are removed from the high pressure separator by means of pipe 26, and are subsequently sold after further processing, if necessary. The sales gas may advantageously be further dried by the removal of water using for example, a conventional glycol dehydration system as previously described. Liquid water collected in separator 20 is removed through a pipe 31 in a conventional manner. The intermediate pressure or staging separator 30 is generally operated at pressures of less than about 125 psig. Most of the absorbed natural gas and some of the higher vapor pressure components of the condensates removed from the high pressure separator 20 will be flashed from the liquid phase into the vapor phase in the intermediate pressure separator 30. As shown in FIG. 2, the intermediate pressure separator 30 consists of a tank 35, a water dump line valve 36, an oil (condensate) line dump valve 37, an oil liquid level control and water liquid level control (not shown), a thermostat 39, a heat exchange coil 34, a bypass line 32, and a three way temperature splitter valve 33, as well as safety and control monitoring devices such as gauge glasses, safety release valves and the like. The oil dump valve 37, which operates in response to the oil liquid level control (not shown), passes oil from the intermediate pressure separator 30 via pipe 44 into a conventional storage tank means 50, (shown in FIG. 1). The primary function of the intermediate pressure separator 30 is to flash at a higher than atmospheric pressure most of the absorbed natural gas and high vapor pressure components of the condensates into a vapor phase. The flashed gases are removed from intermediate pressure separator 30 by means of a pipe 40 through a back pressure valve 41 and conveyed through a conduit 42 into a multiple stage compression system 46, shown in detail in FIGS. 4 and 4*a*.

Residual hydrocarbons in the gas stream produced in the secondary separation means 30 and compressed in the compression system 46 are recycled by delivery from the compression system to the heated wellhead effluent stream by conduit means 92, 94 which may include heat exchanger and valve means 32, 33, 34 in secondary separator means 30. In this manner, all residual light end hydrocarbons not released to the sales gas stream in primary separator 20 are further processed in secondary separator means 30 which provides a liquid body of hydrocarbons substantially free of light end hydrocarbons for delivery to the storage tank means 50 while producing a secondary gaseous stream of hydrocarbons which is recyclable after passing through the compression system 46 as hereinafter described.

Figure 3:
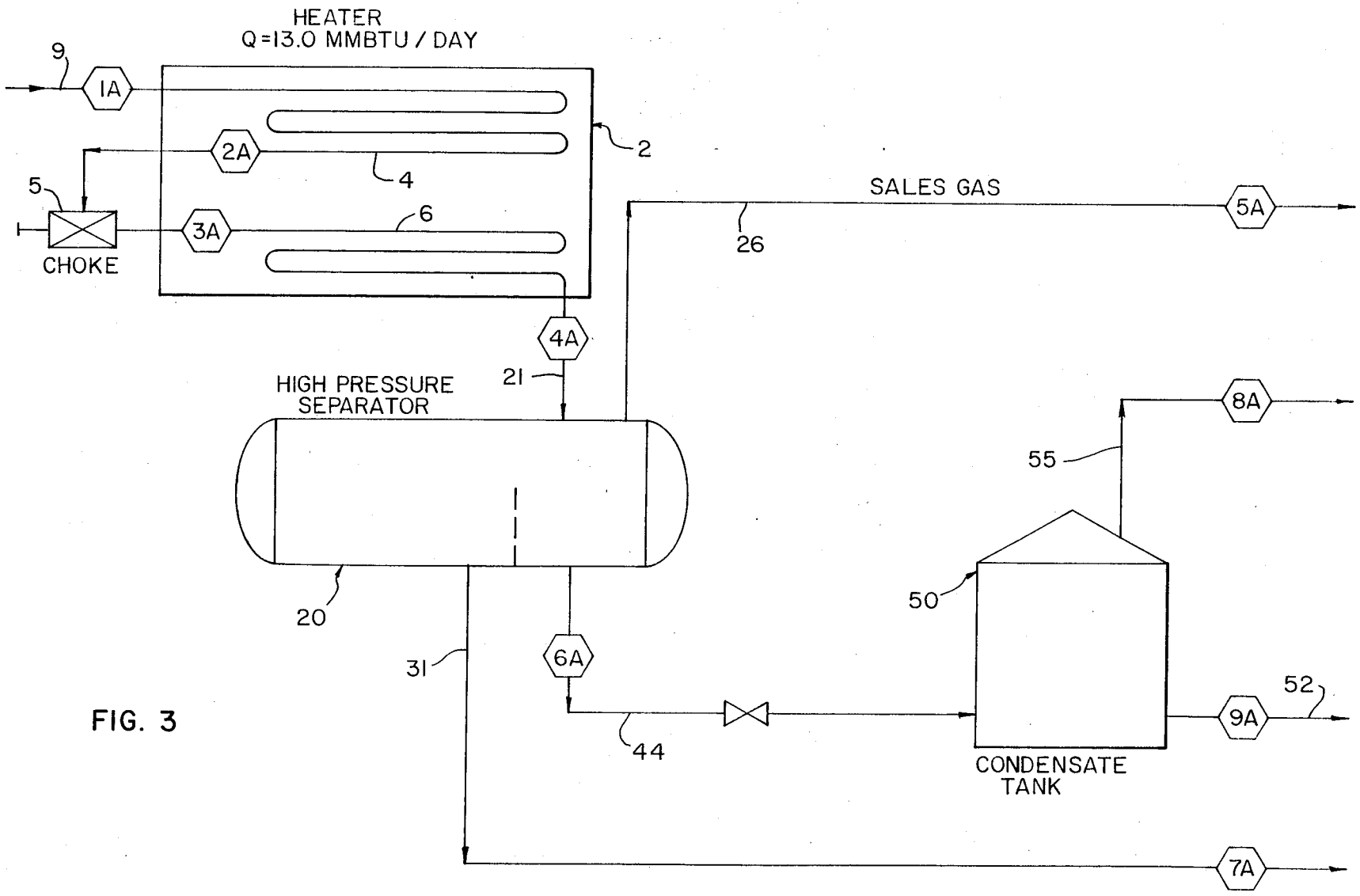
FIG. 3 is a schematic of a typical, single, high pressure gas-liquid separator process which does not employ the present invention.

The liquid condensate storage tank 50 operates at nearly atmospheric pressure. The further pressure reduction from the pressure in the intermediate pressure separator 30 will permit some further flashing of the hydrocarbons to occur as the pressure is reduced. A pressure relief valve 51 as shown in FIG. 1, is provided for pressure control on the storage tank 50. Condensate is selectively removed from storage tank 50 through discharge pipe 52. The flashed gases and vapors are removed from storage tank 50 by means of a vent pipe 55. FIG. 3 shows a typical conventional system wherein heavy end condensate (oil) is directly delivered from high pressure separator means 20 to storage tank means 50 in a relatively unstable condition with resulting loss of substantial amounts of light end hydrocarbons.

Figure 4:
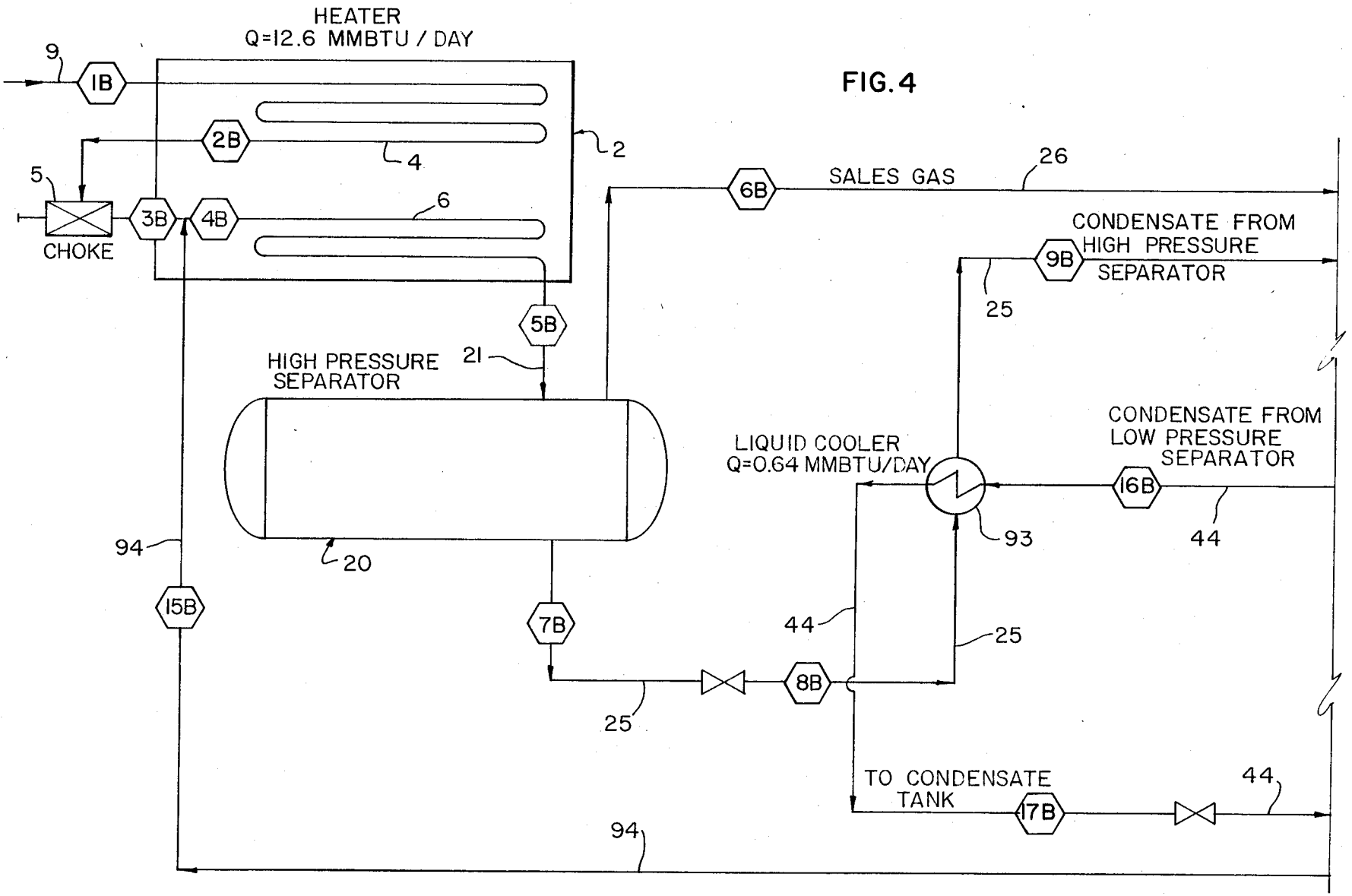
FIGS. 4 and 4*a* are a schematic of one embodiment of the present invention.
Figure 4A:
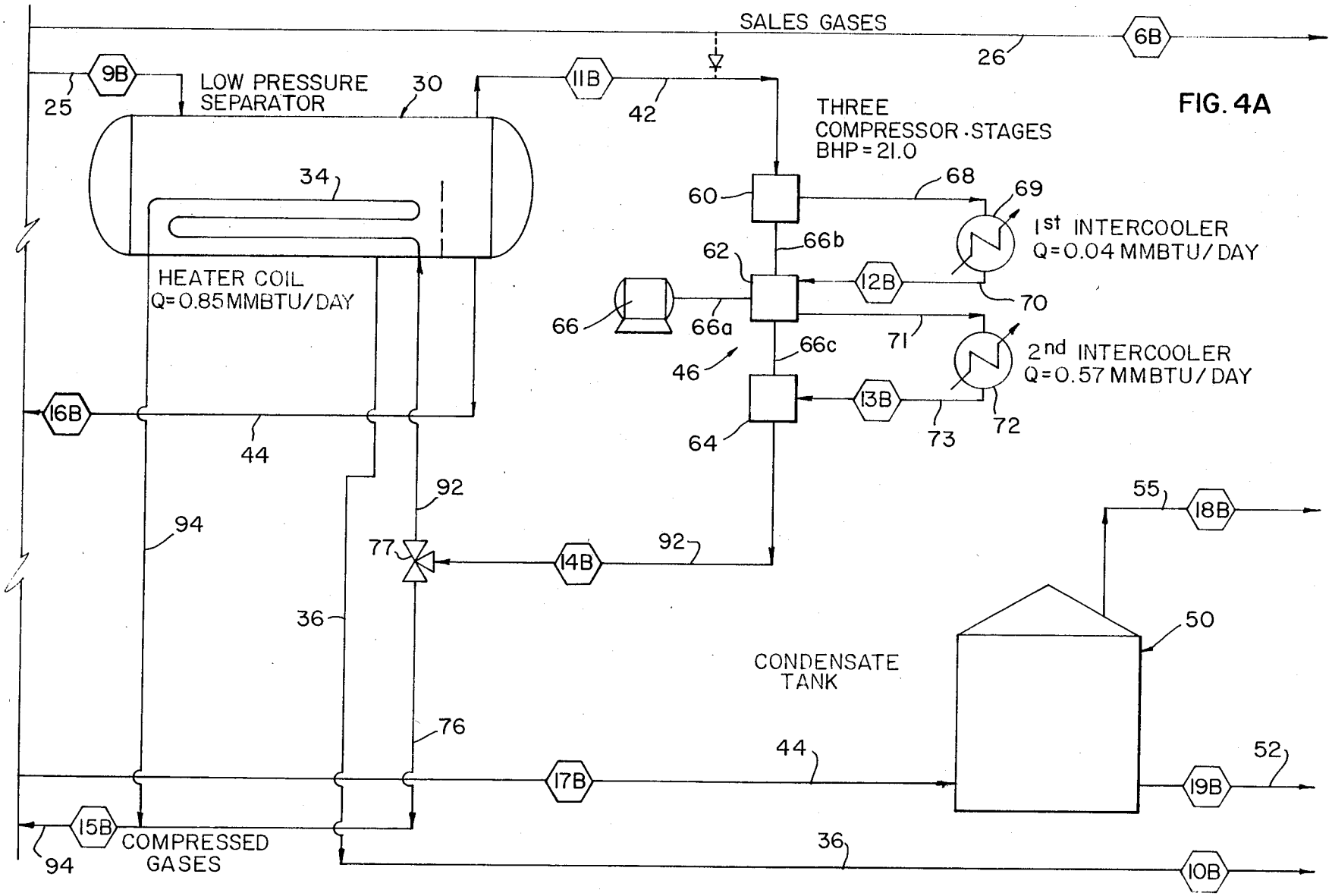

As shown in FIG. 4*a* multiple stage compression system 46 comprises a series of conventional compressor cylinder-piston units 60, 62, 64 driven by conventional motor means 66 through suitable drive means 66*a*, 66*b*, 66*c*. Gaseous hydrocarbons in low pressure separator 30 are delivered to first stage compressor unit 60 through line 42 and compressed therein to raise the temperature and pressure thereof. The compressed gaseous hydrocarbons are then delivered to the second stage compressor unit 62 through a line 68, a conventional forced draft intercooler unit 69, including an inner-stage separator and a line 70. The gaseous hydrocarbons are again compressed in compressor unit 62 and then delivered to third stage compressor unit 64 through a line 71, a second forced draft intercooler unit 72, including an inner-stage separator and a line 73. The innercooler units 69, 72 cause reduction of temperature of the relatively high pressure high temperature gaseous hydrocarbons resulting in the recondensing and then removal of additional liquid heavy end hydrocarbons which are delivered to the condensate tank 50 through suitable line means (not shown). The remaining relatively high pressure high temperature gaseous hydrocarbons are delivered indirectly from the final compressor unit 64 to heater unit 2 (FIG. 4) between choke valve 5 and heating coil 6 through discharge lines 92, heat exchanger means 34, line 94, or directly through bypass line 76 as determined by pressure control valve means 77. Water collected in separator 30 is removed in a conventional manner through discharge line 31. The multiple stages of compression provided by compression system 46 may be used to compress the gas up to the pressure of the gas line immediately downstream of the choke valve 5 in the heater 2. Preferably the compressed gases are transferred, as by line 92, shown in FIG. 2, to heat exchanger 34 in the staging separator 30 to recover some of the heat of compression to heat the fluids in the staging separator for greater gas and vapor recovery from the separated liquids in the staging separator before the liquids are discharged to the storage tank 50. Most preferably the compressed gases from the transfer pipe 92 are introduced into the three way temperature control splitter valve 33 which is external of the staging separator 30. The three way splitter valve 33 controls the introduction of the high pressure and high temperature compressed gases from the compressor means by means of a thermostat 39 which senses the temperature of the liquids contained in the separator 30. The three way splitter valve 33, receiving the gases and vapors from the last stage of the compressor means diverts the high pressure, high temperature gases either directly to heat exchanger 34, inside the staging separator 30, when required, or bypasses the heat exchanger 34, depending on the conditions required in the intermediate pressure separator 30, and then through transfer line 94 for reintroduction of the gas and vapor into the gas heating coil 6 contained in heater 2 at a point downstream of choke valve 5. The heat from the heated liquids in the staging separator may be used to raise the temperature of the liquids going to the staging separator from the high pressure separator and to cool the liquids going to the storage tank 50 by providing a heat exchanger 93, FIG. 4, between these two lines.

Figure 5:
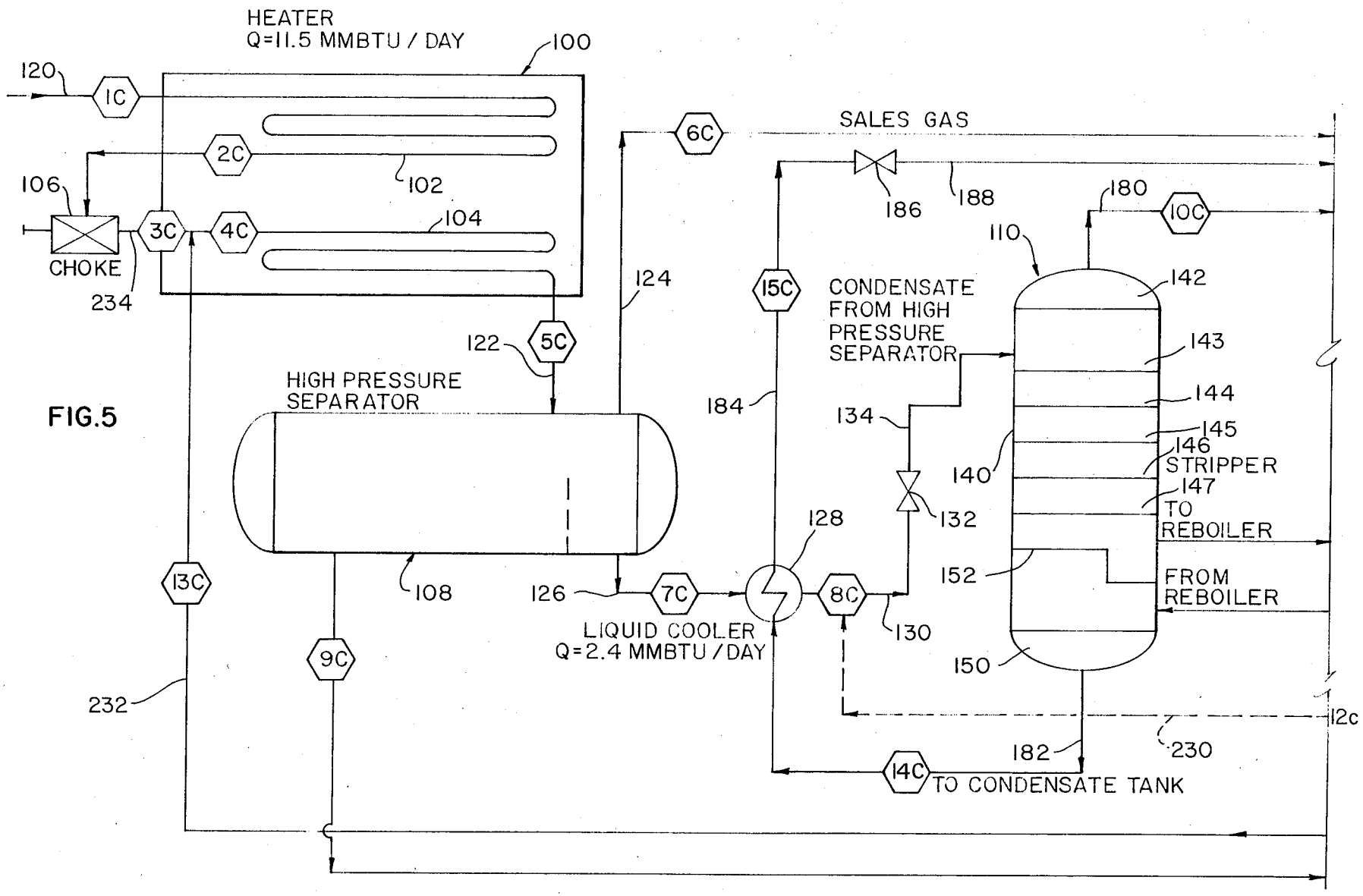
FIGS. 5 and 5*a* are a schematic of another embodiment of the present invention.
Figure 5A:
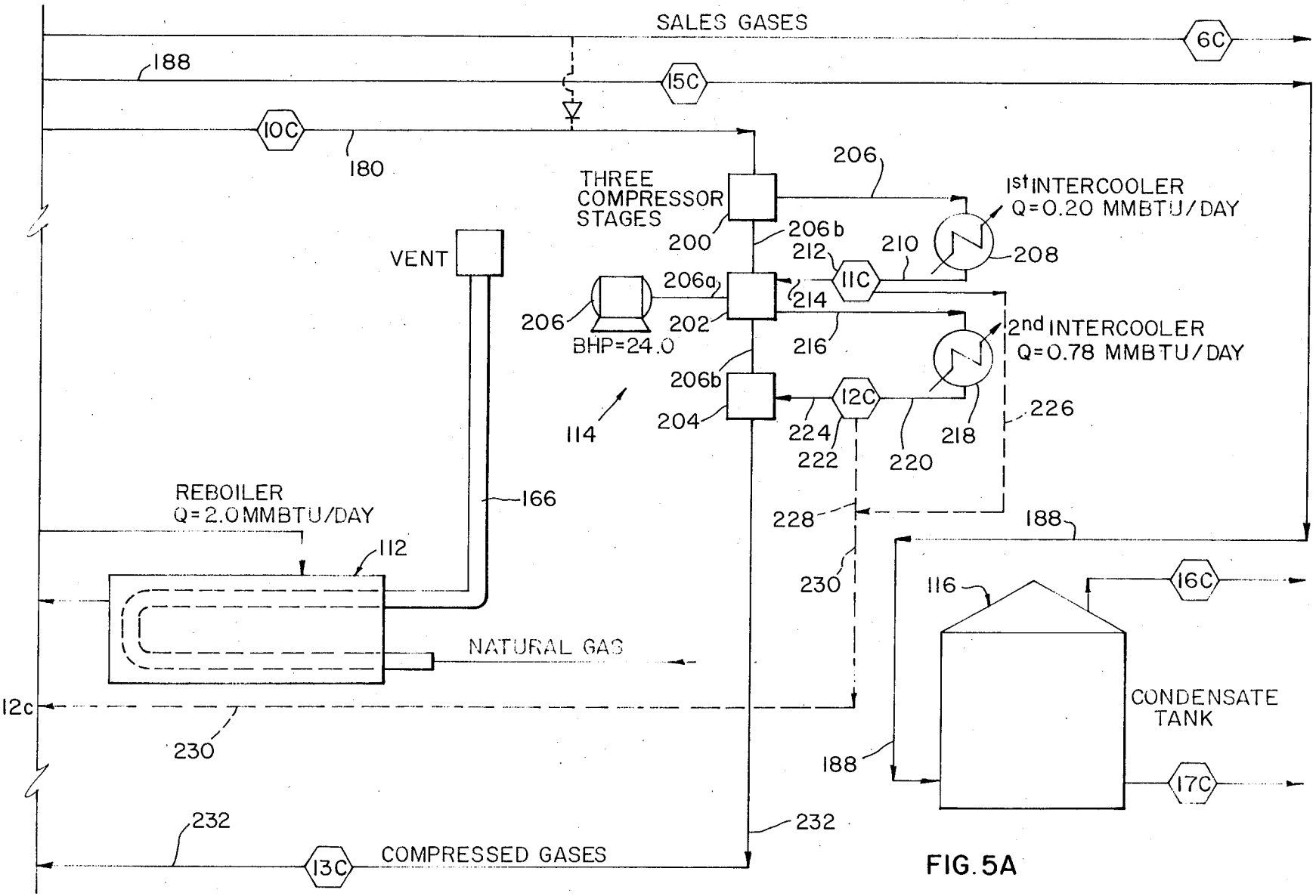

In the embodiments of FIGS. 5, 5*a* and 6–9, utilizing a stripper type separator in the place of the low pressure separator 30, a natural gas fired reboiler heating means (FIGS. 8 and 9) is employed with a tray type column stripper unit (FIG. 7) to stabilize the heavy end liquids going to the storage or condensate tank. The recovered gases and vapors from the stripper unit are then also compressed, as in the first embodiment, and the gases and vapors are returned to the wellhead gas downstream of the choke valve, as previously described. Condensate from the inner-stage separators is returned to the stripper unit for additional separation of additional hydrocarbon gas and vapors. The condensate from the stripper is transferred to the storage tank. Condensate recovered from the compressed gases and vapors from the compressor means are returned to the stripper feed stream such as shown in FIG. 5A. Sales gas from the sales gas line is used to maintain the compressor suction pressure. The use of the sales gas stream for this function will of course require controllable valve means and pressure reduction means, not shown.

As shown in FIGS. 5 & 5*a*, in general, the stabilizer-stripper embodiment of the invention comprises a heater means 100 having a first coil means 102 and a second coil means 104 separated by a choke means 106; a conventional relatively high pressure, three phase separator means 108; a stripper means 110 including a gas burner reboiler heating means 112; a compressor means 114; and condensate storage tank means 116.

Wellhead effluent, including a variety of hydrocarbon products and water, in gaseous and liquid phases, is delivered to coil means 102 from an inlet line 120. The wellhead effluent is heated in coil means 102 by a fluid medium in the heater means 100 maintained at a predetermined elevated temperature by a conventional gas fired burner tube and burner (not shown). The heated wellhead effluent then passes through choke means 106 to reduce the pressure which also results in some temperature reduction. The reduced pressure and temperature effluent then passes through second heating coil means 104 to establish optimum elevated temperature and pressure conditions for processing in the high pressure separator means 108 at elevated temperatures. The pre-conditioned relatively high temperature (e.g., 70° F. to 120° F.) and relatively high pressure (e.g. 900 psig to 1200 psig effluent passes from coil means 104 through a line 122 to a conventional high pressure separator means 108 wherein elevated pressures and temperatures of the effluent are maintained to continuously remove and form bodies of water and hydrocarbons in liquid phase while enabling passage of a substantial amount of light end hydrocarbons in gaseous phase to a natural gas sales line 124.

The separated body of hydrocarbons in liquid phase (condensate) in separator means 108 also includes a commercially significant amount of recoverable light end hydrocarbons in gaseous and liquid phases. In order to recover and remove the light end hydrocarbons, the separated hydrocarbons are delivered to a conventional stripper means 110 through a line 126, a conventional heat exchange means 128 which raises the temperature of the separated hydrocarbons, a line 130, a conventional liquid level control valve means 132, and a line 134.

Figure 7:
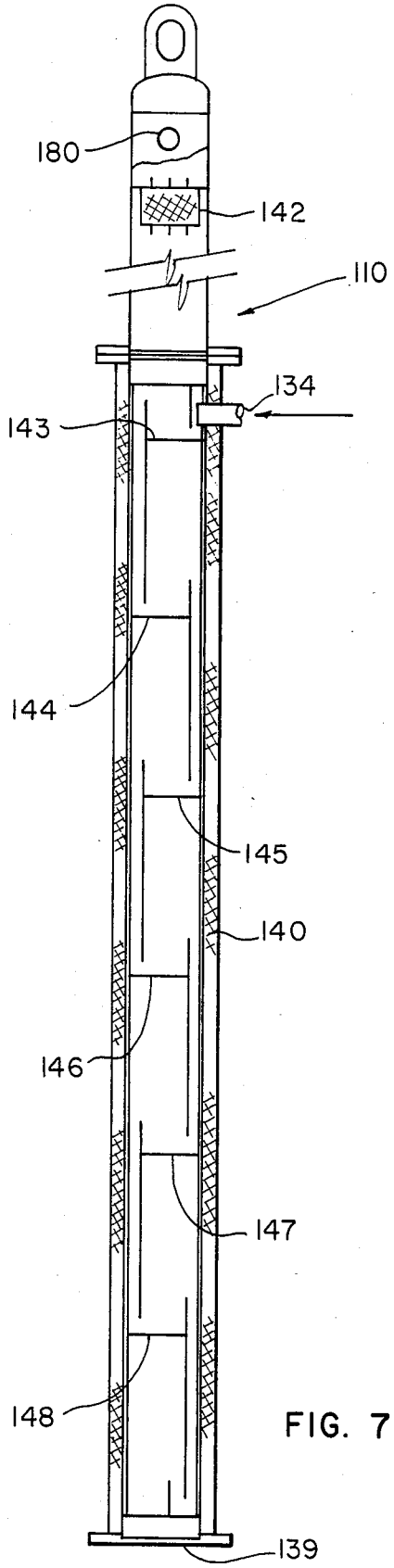
FIG. 7 is a side elevation of a trayed stripping tower useful in one embodiment of the present invention.
Figure 8:
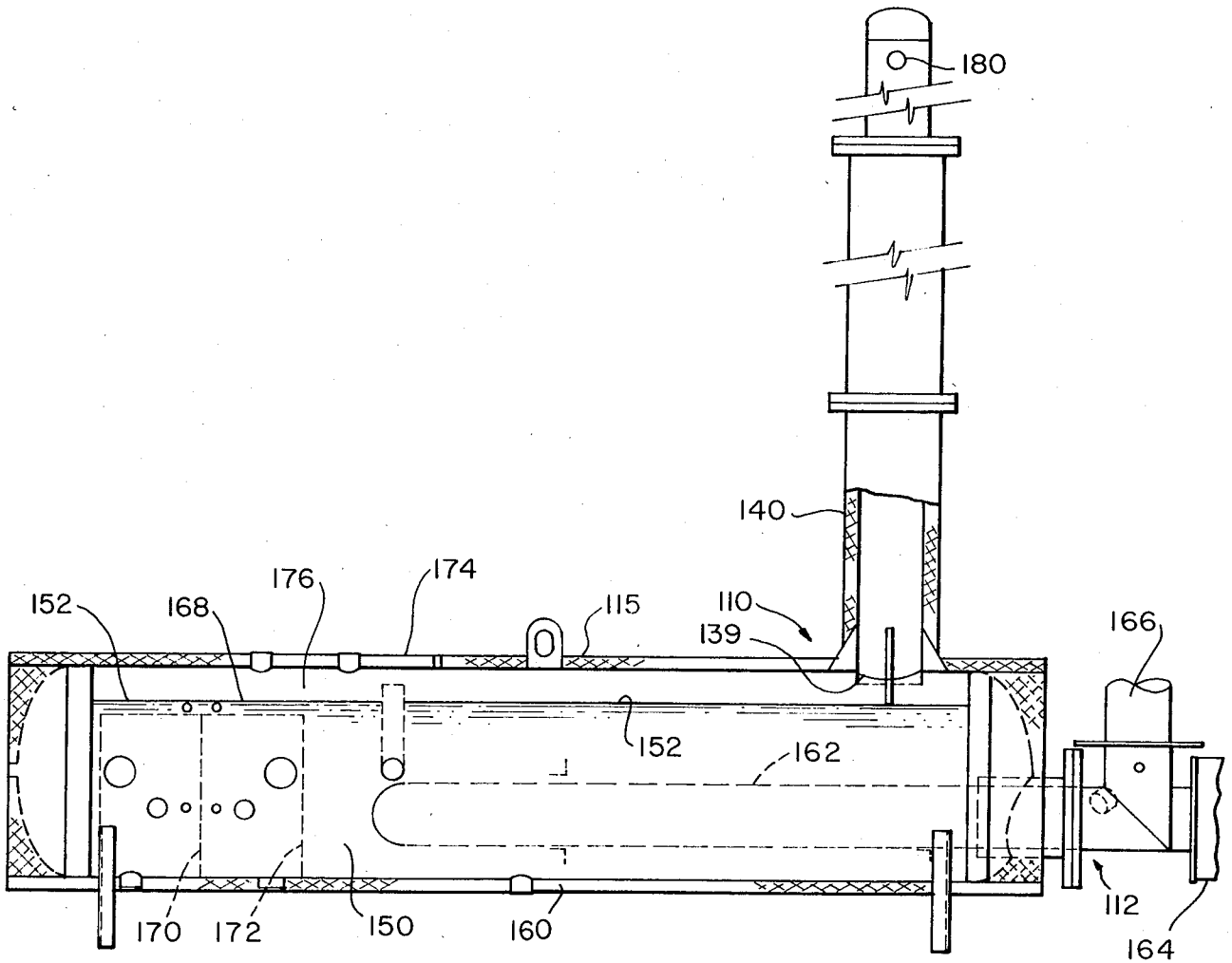
FIG. 8 is a side elevation of a reboiler useful with the stripping tower shown in FIG. 7.
Figure 9:
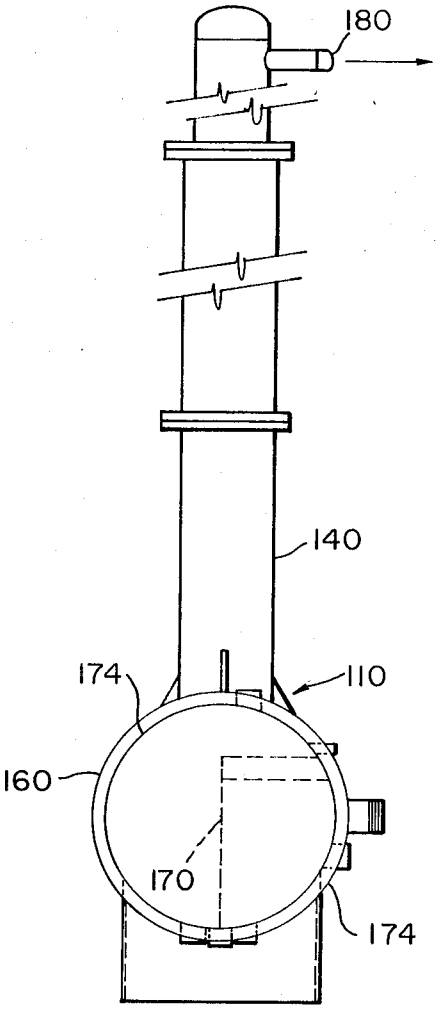
FIG. 9 is an end view of the reboiler shown in FIG. 8.

As shown in FIGS. 7–9, the stabilizer-stripper means 110 may comprise a vertical elongated insulated tubular member 140 containing a series of vertically spaced valve or bubble-cap tray devices 143, 144, 145, 146, 147, 148 (FIG. 7) mounted above a liquid sump or collection means 150 (FIG. 8) associated with a reboiler heating means 112 and weir means 152 for separating and collecting water and heavy end hydrocarbons in liquid phase. As the separated hydrocarbons enter the top portion of column 140 through line 134, there is an initial expansion resulting in reduction of temperature and pressure causing some light end hydrocarbons to be released in a gaseous phase for upward flow through mist extractor 142 to discharge line 180 connected to first stage cylinder 200 of the compressor means 114. The remaining liquid hydrocarbons and gaseous hydrocarbons entrained therein flow downwardly in tank 140 from tray to tray until reaching liquid sump 150 provided by an horizontal, insulated, tubular member 160 having a fire tube 162 therein sealably connected at one end to a natural gas burner 164 with a vent stack 166 as shown in FIGS. 8 and 9. The level of liquids 168 in liquid sump 150, including a water collection box 170 and an oil (condensate) box 172, is maintained in vertically downwardly spaced relationship to the upper wall portion 174 of tubular member 160 to provide a vapor chamber 176. Liquids in sump 150 are continuously heated to provide high temperature gaseous (vapor) phase hydrocarbons which rise in vertical tubular member 140. The high temperature gaseous phase hydrocarbons heat and gradually increase the temperature of the downwardly moving liquid hydrocarbons while being gradually decreased in temperature as they rise in tubular member 140. In this manner, a substantial amount of heavy end hydrocarbons in gaseous phase return to the liquid phase and are carried back to the liquid sump 150 and into oil collection box 172 while substantially all of the light end hydrocarbons and a relatively small amount of heavy end hydrocarbons in gaseous phase are driven upwardly to the top of vertical tubular member 140 for removal through mist eliminator 142 and an outlet line 180 for delivery to compression means 114, FIG. 5A. The relatively high temperature (e.g. 200°–220° F.) liquid heavy end hydrocarbons, in the form of substantially light end free oil, are removed from oil box 172 through a line 182, FIG. 5, heat exchanger means 128, wherein the oil condensate is cooled while the separated liquid in line 126 is heated, a line 184, a flow control valve means 186 and a line 188 for delivery to the storage tank means 116 at substantially atmospheric conditions. In this manner, there is substantially no flashing of any light end hydrocarbons in the storage tank means and the vapor pressure of the liquid hydrocarbons can be closely controlled to obtain a predetermined vapor pressure (e.g. 8 psi to 12 psi Reid vapor pressure at 100° F.).

In order to recover substantially all hydrocarbons without loss to atmosphere of any light end hydrocarbons in gaseous phase, the gaseous phase hydrocarbons (including both light and heavy end hydrocarbons) removed from stripper means 110 are subject to further processing as hereinafter described. Compressor means 114 preferably comprises a series of conventional compressor-type cylinder-piston units 200, 202, 204, driven by conventional motor means 206 through drive coupling means **206*a*, 206*b*, 206*c*, to provide multiple stages (e.g. 3) of compression. The gaseous hydrocarbons from stripper means 110 are first compressed in compressor cylinder 200 to raise temperature and pressure thereof. The relatively higher elevated temperature and relatively higher pressure compressed hydrocarbons are discharged from compressor cylinder 200 to compressor 202 through a line 206, a conventional forced draft air type inter-cooler means 208, a line 210, a conventional gas and liquid inner-stage separator means 212 and a line 214. The increase in pressure and reduction of temperature of the compressed gases cause some of the heavy end hydrocarbons to change from gaseous phase back to a liquid phase whereby additional heavy end hydrocarbons are separated from gaseous light end hydrocarbons. This compression process may be repeated by compression of remaining gaseous hydrocarbons in compressor means 204 through line 216, heat exchanger means 218, line 220, separator means 222 and line 224. The liquid heavy end hydrocarbons obtained in separator means 212, 222 are recycled in the stripper means 110 by delivery to line 130 through lines 226, 228 and 230. The remaining gaseous hydrocarbon products from compressor means 202 are delivered to third stage compressor means 204 wherein the temperature and pressure is increased to enable flow to secondary heater coil means 104 through a discharge line 232 connected to line 234 downstream of choke means 106 and upstream of secondary heater coil means 104. Thus, all of the hydrocarbons removed from the stripper means 110 through discharge line 180 are subject to further processing in a closed loop system wherein there is further removal of liquid heavy end hydrocarbons returned to the stripper means for recycling and return of gaseous phase hydrocarbons substantially free of heavy end hydrocarbons for further recycling through the high pressure separator means 108**.

As a consequence of the recycling system, the BTU content and volume of the sales gas is substantially increased to provide an enriched more valuable sales gas in line 124. In addition, the volume of heavy end liquid condensate collected in condensate tank means 116 is substantially increased and is substantially free of light end components whereby the prior art problems of flashing and weathering are substantially eliminated. Furthermore, the vaporization pressure of the condensate may be closely controlled at or about atmospheric pressure. There is substantially no loss of gaseous hydrocarbons to the atmosphere because the recycling processing systems are of a closed loop-type wherein the hydrocarbons are returned to either the high pressure separator means 108 through heating coil means 104 or to the stripper means 110. In the present processing system, the gaseous and liquid hydrocarbons are continuously processed at elevated temperatures and elevated pressures until substantially all the light end liquid hydrocarbon components enter the sales gas line in a gaseous phase from the high pressure separator means 108 and substantially all the heavy end liquid hydrocarbons are discharged from the stripper means 110 to the storage tank means 116.

In the embodiments shown, the selection of compressor capacity, innercooler capacity between compression stages and other equipment described, can be selected from conventional commercially available components to satisfy the overall system requirements for a particular natural gas well.

In operation, the well-head gases from a natural gas well are conveyed into a gas heating coil 4 which is totally immersed within indirect heating medium 3 contained in the heater 2. The heater 2 is heated by means of a typical fuel gas burner 12 controlled by valve 11 which is responsive to a thermostat 8 in high pressure gas liquid separator 20 which senses the gas temperature in separator 20 and controls the amount of fuel gas flowing to the burner assembly 12. In this manner the temperature of the indirect medium in heater 2 can be changed, as required, to meet the gas temperature requirements of high pressure separator 20. Normally, the heating medium 3 is maintained at a temperature which is dependant on the composition and pressure of the wellhead gas to obtain the optimum separation of the gases and liquids in the high pressure separator 20 while still permitting the reintroduction of compressed gases and vapors from the compression means for the hydrocarbon enrichment of the product gas stream and enhanced liquid hydrocarbon recovery described herein.

In addition to the temperature control provided by the thermostat 8 and the fuel gas control valve 11, high pressure and high temperature compressed gases are introduced from the third stage of the multiple stage gas, compression system shown in FIGS. 4, **4*a*, 5, and 5*a* into a heating coil 6 which is connected to heating coil 4 through a choke valve means 5. The high temperature, high pressure compressed gases are introduced downstream of choke valve 5 which normally reduces the wellhead pressure to between about 1000 psig and 400 psig. The wellhead pressures and flowing line pressures encountered in the field will vary widely, however, the advantages of the present invention can still be achieved to different degrees at pressures higher or lower than described. The expansion of the gases exiting from choke valve 5 produces a degree of cooling below the desired operating temperatures thereby requiring a predetermined residence time in the second heating coil 6 for additional heat absorption so that the temperature sensed at 8** will be at the proper predetermined value.

This reduction in temperature and then reheating is desirable for the enhanced recovery of gases and liquid hydrocarbons which can be achieved by the present invention. The cooling provides for greater condensation of the heavier hydrocarbon vapor components of the compressed gases. Therefore, the introduction of high pressure and high temperature compressed gases into the well-head gas after choke valve 5 and before additional heating in heating coil 6, increases the liquid hydrocarbon content in the gas stream.

Any liquid condensates from the compressed gases and vapors that are present in the gas-liquid stream flowing through line 21 are introduced into the conventional high pressure separator 20, as previously described, and are mechanically separated along with the other liquid hydrocarbons by internal baffles and the like (not shown), to provide for a relatively condensate free sales gas product exhausted from the high pressure separator 20 through line 26. High pressure separator units of the type which can be used advantageously in the present invention are commercially available.

As the liquid level in high pressure separator 20 increases, the liquid level control 7 actuates motor valve 22 so that the liquid condensates can be exhausted via pipe 23 and line 25 to staging separator 30. The intermediate pressure separator 30 is maintained at a lower pressure than the high pressure separator 20. Under the conditions of temperature and pressure selected for the operation of the staging separator 30, most of the absorbed natural gas and higher vapor pressure hydrocarbon components contained in the condensates will flash into the vapor phase. The flashed gases are permitted to flow through line 40 and through back pressure valve 41 and line 42 for subsequent compression in the multiple stage compression system. The staging separator 30 also accumulates liquid condensates which include both hydrocarbons as well as water. The water level in intermediate pressure separator 30 can be controlled by means of a liquid level control, which is commercially available, that is responsive to the rise in the hydrocarbon-water emissible phase and controls dump valve 36 which will exhaust a portion of the water to waste, under the pressure of the flashed vapors in the staging separator 30. A second liquid level control is provided which is responsive to the level of the hydrocarbon condensates in the staging separator 30 to control a valve 37 which when open will, in a like manner, remove a portion of the hydrocarbon condensates through line 44 and into storage tank 50, shown in FIG. 1. Typical float operated controls which are suitable for this purpose are available from Kimray, Inc. and Custom Engineering and Manufacturing Corp., of Tulsa, Okla.

As previously described, the high temperature, high pressure compressed gases, vapors and liquids from the compression means, including the inter-coolers shown in FIGS. 4, 4*a*, 5, and 5*a*, are introduced via line 92 into a three way temperature control splitter valve 33. A thermostat 39 sensing the temperature of the hydrocarbon condensates in the staging separator 30 controls the flow of the high temperature, high pressure compressed gases and vapors from line 92 through either a by-pass line 32 or heat exchanger 34 depending on whether additional heating is required for the condensed hydrocarbons in the staging separator 30 for the desired flashing of the high vapor pressure components of the condensed hydrocarbons to occur.

The liquid hydrocarbons from staging separator 30 which pass through line 44 are introduced to the storage tank 50 which operates at about atmospheric pressure. Under these conditions of temperature and pressure the hydrocarbons introduced from the staging separator 30 will undergo some further flashing of the remaining high vapor pressure components as well as releasing some absorbed natural gas and the like. The reduction in flashed vapors expected to be produced by this system can be seen in Table 3, Column 18A. When necessary, storage tank 50 can be evacuated through a valve in discharge line 52.

As shown in FIGS. 5, 7, 8 and 9, in the preferred embodiment of the invention, a trayed stripping tower is employed to achieve the desired increase in sales gas volume, and BTU content by the recovery of the hydrocarbons, gases and vapors that would otherwise be vented and wasted during the flashing in the storage tank and by weathering of the condensate in the storage tank.

A typical trayed stripping column 100 which will accomplish the objects of this invention is shown in FIG. 7. The outer tube 140 contains tray spacing defined by bubble trays as shown at 143 and 144. The condensate from the high pressure separator is introduced at 134 and descends through the trays countercurrent with heated gases and vapors introduced at 139. The resultant gases and vapors are discharged to compressor suction at 180. The column size, that is, its length and diameter can be selected for the specific application.

The heated gases and vapors introduced at 139 can be obtained by the use of a typical reboiler type separation unit such as shown in FIGS. 8 and 9, with the stripping column 140 shown in place. A gas fired fire tube 162 is employed on the inside of the horizontal reboiler 160 and controlled (not shown) to achieve the specific temperatures required for heating the condensate that descends through the stripping column 140 to produce the gases and vapors which will ascend countercurrently in contact with the condensate to flash the desired dissolved hydrocarbons and high vapor pressure gases for reintroduction into the well gas stream, as previously described.

Figure 6:
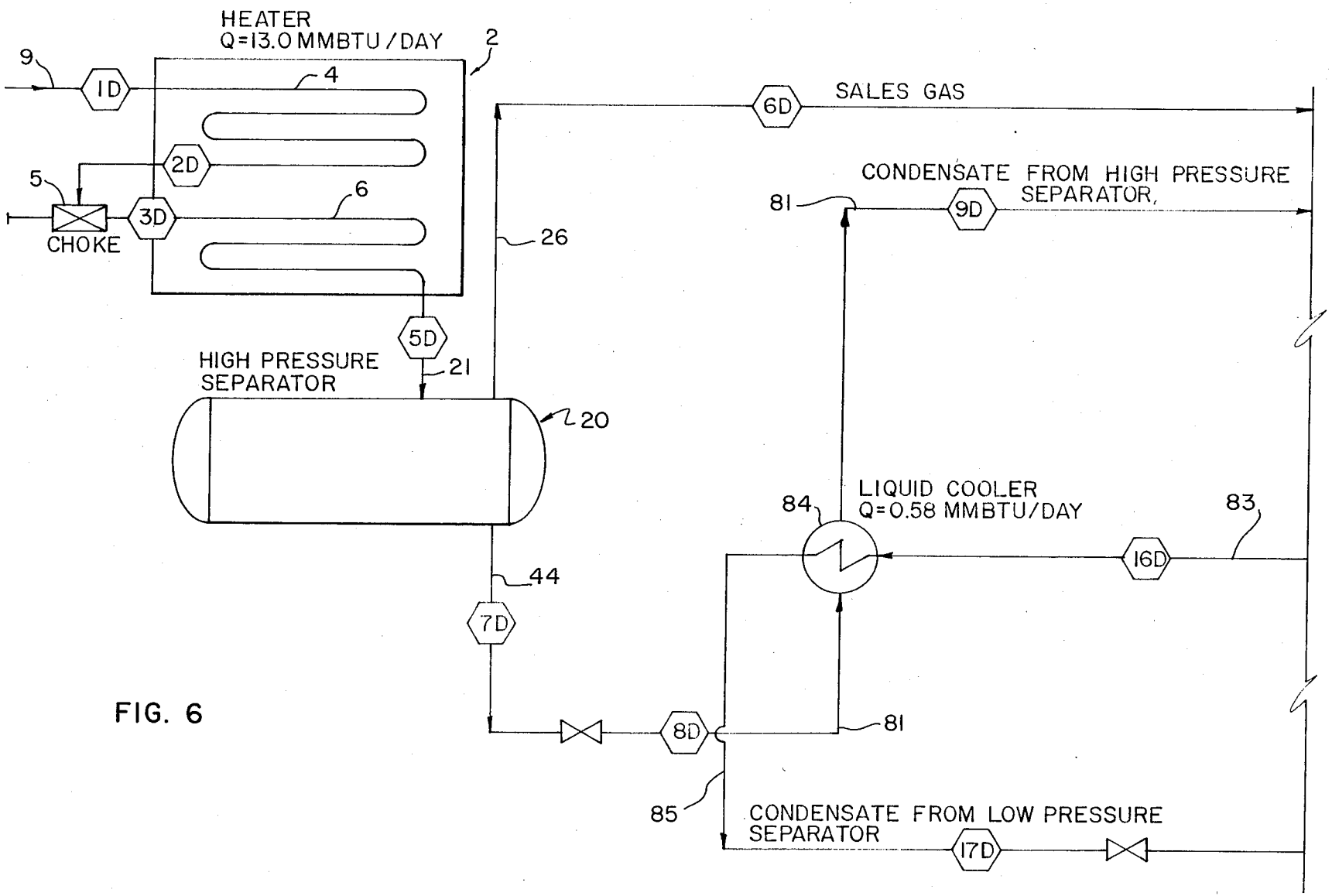
FIGS. 6 and 6*a* are schematic drawings of a typical system of the type shown in FIG. 3 utilizing a staging separator.
Figure 6A:
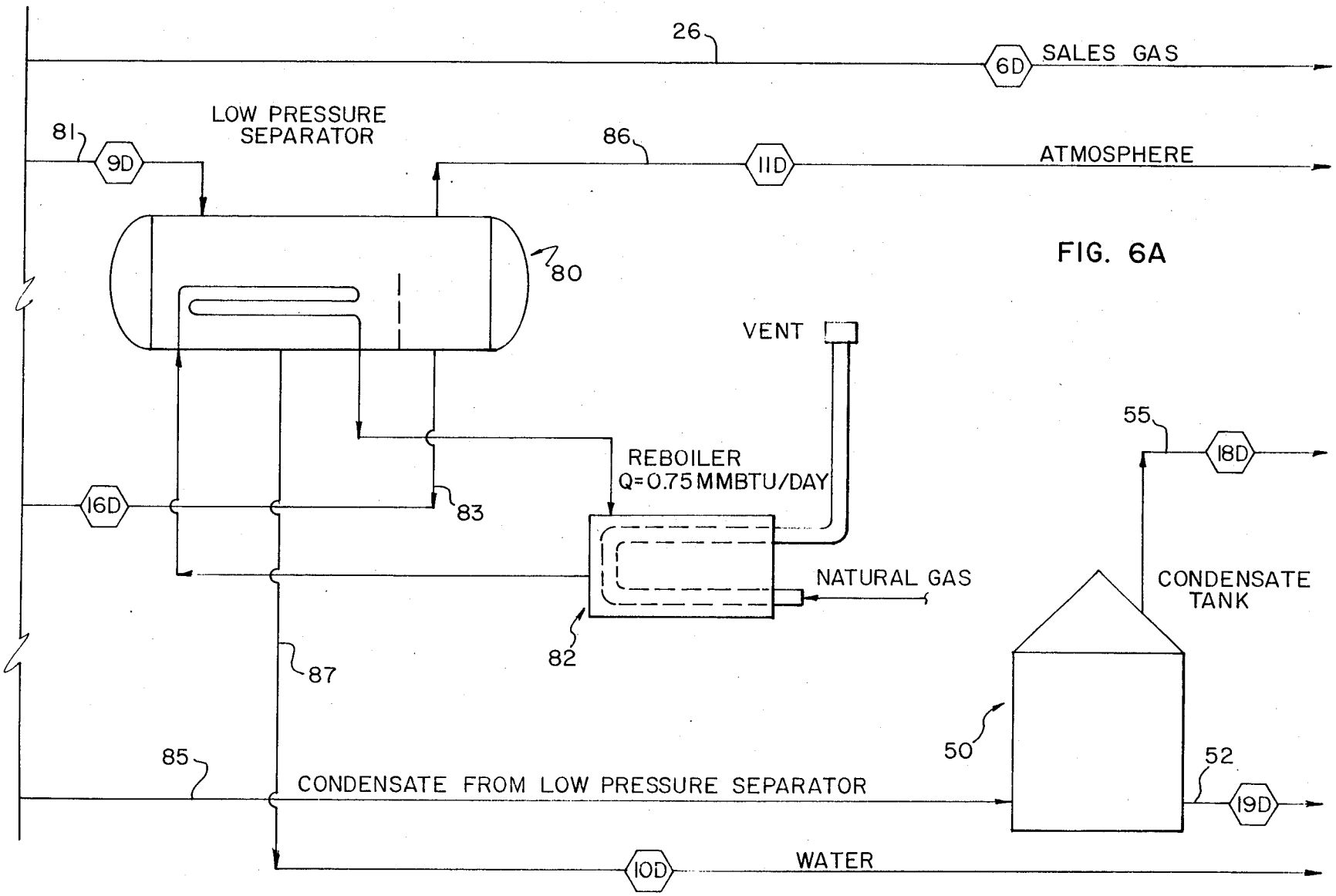

FIGS. 6 & 6A show, for purposes of comparison of results, a typical conventional system wherein a second stage low pressure separator means 80 is connected through condensate discharge conduit means 44 and a condensate conduit means 81 to primary stage high pressure separator means 20 with heating in the low pressure separator means of condensate from the high pressure separator means by a reboiler means 82 prior to delivery of condensate from the low pressure separator means 80 to the condensate tank means 50 through a conduit means 83, a heat exchange means 84 and a conduit means 85. Gaseous by-products in the low pressure separator means 80 are typically vented to the atmosphere through conduit means 86. Water is removed through conduit means 87.

The following examples of test operation of the systems of the present invention have shown superior results in comparison with the usual results using conventional equipment of the type shown in FIGS. 3, 6 & 6A not employing the present invention. The performance data was simulated using established data from Northern California Gas Company's (NCG) well number 3–14. The well data and feed composition used for the simulation are shown in Table 1. The well-head gas composition is based on analysis of current product natural gas combined with a typical condensate analysis for the well. Block numbers on the drawings correspond to stream numbers on the data charts provided hereinafter.

TABLE 1

| WELL HEAD GAS DATA | | | |
|---|---|---|---|
| WELL DESIGNATION: | NCG WELL NO. 3–14 | | |
| Nominal Flow Rate | MMSCFD = 4.5 | | |
| WELL HEAD | | | |
| Flowing Pressure (Pf) Psig = | 215Ø | | |
| Flowing Temperature (Tf) °F. = | 75 | | |
| Phase at Tf and Pf = | MIXED | | |
| GAS RATE | VAPOR FRACTION | LIQUID FRACTION | TOTAL |
| LH/DAY | 238,645 | 39,809 | 278,454 |
| M SCFD | 4,425.5 | | |
| gal/day | | 8537.8 | |

| WELL HEAD GAS ANALYSIS | | |
|---|---|---|
| COMPONENT | % MOLE | LB MOLE/DAY |
| $H_2O$ | 0.04 | 4.8 |
| $C_1$ | 80.90 | 10070.55 |
| $CO_2$ | 2.04 | 254.5 |
| $N_2$ | 0.20 | 24.3 |
| $C_2$ | 8.86 | 1103.1 |
| $C_3$ | 3.72 | 463.0 |
| $IC_4$ | 0.66 | 82.4 |
| $NC_4$ | 0.75 | 93.3 |
| $IC_5$ | 0.10 | 12.1 |
| $NC_5$ | 0.11 | 14.0 |
| $C_6$ | 2.62 | 326.2 |

*$CO_2$ figure includes trance non-hydrocarbon gas analysis.

The results of the computer simulation are shown on Tables 2, 3, and 4 which present the heat and material balance for each situation. In Table 2, the typical results from this particular well is shown where the system only employs a conventional heater, high pressure separator and condensate tank. Normal levels of product natural gas volume, condensate tank vapor and condensate are shown as well as the typical hydrocarbon composition of the natural gas product, condensate tank vapor and storage tank condensate.

TABLE 2

| Description | STREAM 1A WELL HEAD GAS | % | 2A CHOKE INLET | 3A CHOKE OUTLET | 4A HEATER OUTLET | 5A PRODUCT NATURAL GAS | % | 6A H.P. SEPARATOR LIQUID | 7A WATER DRAW | 8A CONDEN-SATE TANK VAPOR | % | 9A CONDENSATE | % |
|---|---|---|---|---|---|---|---|---|---|---|---|---|---|
| Moles/Day | | % | | | | | % | | | | % | | % |
| " $C_1$ | 10070.5 | 30.90 | 10070.5 | 10070.5 | 10070.5 | 9942.6 | 83.72 | 127.9 | NEGL. | 127.2 | 44.17 | 0.7 | 0.25 |
| " $CO_28N_2$ | 278.8 | 2.24 | 278.8 | 278.8 | 278.8 | 272.2 | 2.29 | 6.6 | | 6.5 | 2.26 | 0.1 | 0.03 |
| " $C_2$ | 1103.1 | 8.86 | 1103.1 | 1103.1 | 1103.1 | 1049.6 | 8.84 | 53.5 | | 51.6 | 17.92 | 1.9 | 0.67 |
| " $C_3$ | 463.0 | 3.72 | 463.0 | 463.0 | 463.0 | 407.9 | 3.43 | 55.1 | | 49.2 | 17.08 | 5.9 | 2.08 |
| " $IC_4$ | 82.4 | 0.66 | 82.4 | 82.4 | 82.4 | 65.2 | 0.55 | 17.2 | | 13.2 | 4.58 | 4.0 | 1.41 |
| " $NC_4$ | 93.3 | 0.75 | 93.3 | 93.3 | 93.3 | 68.8 | 0.58 | 24.5 | | 17.1 | 5.94 | 7.4 | 2.61 |
| " $IC_5$ | 12.1 | 0.10 | 12.1 | 12.1 | 12.1 | 7.1 | 0.06 | 5.0 | | 2.4 | 0.83 | 2.6 | 0.92 |
| " $NC_5$ | 14.0 | 0.11 | 14.0 | 14.0 | 14.0 | 7.4 | 0.06 | 6.6 | | 2.6 | 0.90 | 4.0 | 1.41 |
| " $C_{6+}$ | 326.2 | 2.62 | 326.2 | 326.2 | 326.2 | 51.1 | 0.43 | 275.1 | | 17.9 | 6.22 | 257.2 | 90.63 |
| " $H_2O$ | 4.8 | 0.04 | 4.8 | 4.8 | 4.8 | 4.5 | 0.04 | 0.3 | | 0.3 | 0.10 | Trace | — |
| TOTAL | 12448.2 | | 12448.2 | 12448.2 | 12448.2 | 11876.4 | | 571.8 | | 288.0 | | 283.8 | |
| MLB/DAY | 278.4 | | 278.4 | 278.4 | 278.4 | 234.0 | | 44.4 | | 8.7 | | 34.7 | |
| TEMPERATURE °F. | 76.5 | | 104.5 | 51.3 | 85.0 | 85.0 | | 85 | | 75 | | 75 | |
| PRESSURE PSIG | 2150 | | 2140 | 810 | 800 | 800 | | 800 | | 0 | | 0 | |
| ENTHALPY MMBTU/DAY | −2.378 | | 4.022 | 4.022 | 10.637 | 10.511 | | 0.126 | | 1.388 | | −0.116 | |
| PHASE | MIXED | | MIXED | MIXED | MIXED | VAPOR | | LIQUID | | VAPOR | | LIQUID | |
| VAPOR | | | | | | | | | | | | | |
| MSCF/DAY | 4425.5 | | 4496.6 | 4424.8 | 4507.0 | 4507.0 | | | | 109.3 | | | |
| MACF/DAY | 20.8 | | 24.0 | 62.3 | 71.5 | 71.5 | | | | 111.4 | | | |
| LB/CF $T_fP_f$ | 11.4 | | 10.2 | 3.6 | 3.3 | 3.3 | | | | 0.087 | | | |
| HEATING VALUE BTU/SCF | | | | | | 1148 | | | | 1892 | | | |
| LIQUID | | | | | | | | | | | | | |
| GAL/DAY 60° F. | 8537.8 | | 6976.9 | 10177.4 | 8093.9 | (1.517 GAL/ MSCF) | | 8093.9 | | | | 5502.2 | |
| GAL/DAY $T_fP_f$ | 7808.0 | | 6858.4 | 9899.8 | 8189.6 | | | 8189.6 | | | | 5549.4 | |
| SP. GR $T_fP_f$ | 0.611 | | 0.597 | 0.640 | 0.650 | | | 0.650 | | | | 0.750 | |
| API 60° F. | | | | | | | | | | | | 55.6 | |

Table 3 shows the same results from the use of a staging separator and compressor added to the same system and well whose results are shown in Table 2.

TABLE 3

| Description | STREAM 1B WELL HEAD GAS | % | 2B CHOKE INLET | 3B CHOKE OUTLET | 4B CHOKE OUTLET W/RECYCLE | 5B HEATER OUTLET | 6B PRODUCT NATURAL GAS | % | 7B H.P. SEPARATOR LIQUID | 8B H.P. LIQUID TO COOLER | 9B L.P. SEPARATOR FEED | 10B WATER DRAW |
|---|---|---|---|---|---|---|---|---|---|---|---|---|
| Moles/Day | | | | | | | | | | | | |
| " $C_1$ | 10070.5 | 80.90 | 10070.5 | 10070.5 | 10204.3 | 10204.3 | 10067.8 | 83.10 | 136.5 | 136.5 | 136.5 | NEGL. |
| " $CO_2 8N_2$ | 278.8 | 2.24 | 278.8 | 278.8 | 285.5 | 285.5 | 278.5 | 2.30 | 7.0 | 7.0 | 7.0 | |
| " $C_2$ | 1103.1 | 8.86 | 1103.1 | 1103.1 | 1155.9 | 1155.9 | 1097.4 | 9.06 | 58.5 | 58.5 | 58.5 | |
| " $C_3$ | 463.0 | 3.72 | 463.0 | 463.0 | 509.6 | 509.6 | 446.6 | 3.69 | 63.0 | 63.0 | 63.0 | |
| " $IC_4$ | 82.4 | 0.66 | 82.4 | 82.4 | 93.5 | 93.5 | 73.4 | 0.61 | 20.1 | 20.1 | 20.1 | |
| " $NC_4$ | 93.3 | 0.75 | 93.3 | 93.3 | 106.7 | 106.7 | 77.8 | 0.64 | 28.9 | 28.9 | 28.9 | |
| " $IC_5$ | 12.1 | 0.10 | 12.1 | 12.1 | 13.6 | 13.6 | 7.8 | 0.06 | 5.8 | 5.8 | 5.8 | |
| " $NC_5$ | 14.0 | 0.11 | 14.0 | 14.0 | 15.6 | 15.6 | 8.1 | 0.07 | 7.5 | 7.5 | 7.5 | |
| " $C_{6+}$ | 326.2 | 2.62 | 326.2 | 326.2 | 336.0 | 336.0 | 52.9 | 0.44 | 283.2 | 283.2 | 283.2 | |
| " $H_2O$ | 4.8 | 0.04 | 4.8 | 4.8 | 5.1 | 5.1 | 4.8 | 0.04 | 0.3 | 0.3 | 0.3 | |
| TOTAL | 12448.2 | | 12448.2 | 12448.2 | 12726.0 | 12726.0 | 12115.1 | | 610.9 | 610.9 | 610.9 | |
| MLB/DAY | 278.4 | | 278.4 | 278.4 | 286.9 | 286.9 | 240.7 | | 46.2 | 46.2 | 46.2 | |
| TEMPERATURE °F. | 76.5 | | 104.5 | 51.3 | 54.7 | 85 | 85 | | 85 | 50° F. | 71 | |
| PRESSURE PSIG | 2150 | | 2140 | 810 | 810 | 800 | 800 | | 800 | 40 | 35 | |
| ENTHALPY MMBTU/DAY | −2.378 | | 4.022 | 4.022 | 5.101 | 11.296 | 11.145 | | 0.150 | 0.150 | 0.786 | |
| PHASE | MIXED | | MIXED | MIXED | MIXED | MIXED | VAPOR | | LIQUID | MIXED | MIXED | |
| VAPOR | | | | | | | | | | | | |
| MSCF/DAY | 4425.5 | | 4496.6 | 4424.8 | 4515.8 | 4597.6 | 4597.5 | | | 87.7 | 96.3 | |
| MACF/DAY | 20.8 | | 24.0 | 62.3 | 64.0 | 72.7 | 72.7 | | | 22.5 | 28.4 | |
| LB/CF $T_fP_f$ | 11.4 | | 10.2 | 3.6 | 3.6 | 3.3 | 3.3 | | | 0.27 | 0.25 | |
| HEATING VALUE BTU/SCF | | | | | | | 1157 | | | | | |
| LIQUID | | | | | | | | | | | | |
| GAL/DAY 60° F. | 8537.8 | | 6976.9 | 10177.4 | 10596.6 | 8518.7 | (1.631 GAL/ MSCF) | | 8518.7 | 6646.7 | 6394.8 | |
| GAL/DAY $T_fP_f$ | 7808.0 | | 6858.4 | 9899.8 | 10344.7 | 8621.5 | | | 8621.5 | 6602.5 | 6437.4 | |
| SP. GR $T_fP_f$ API 60° F. | 0.611 | | 0.597 | 0.640 | 0.634 | 0.644 | | | 0.644 | 0.730 | 0.727 | |

| Description | STREAM 11B L.P. SEPARATOR VAPOR | 12B 2nd STAGE SUCTION | 13B 3rd STAGE SUCTION | 14B COMPRESSOR DISCHARGE | 15B RECYCLE GAS | 16B L.P. SEPARATOR LIQUID | 17B CONDENSATE TO TANK | 18B CONDENSATE TANK VAPOR | 19B CONDENSATE | | |
|---|---|---|---|---|---|---|---|---|---|---|---|
| Moles/Day | | | | | | | | | % | | |
| " $C_1$ | 133.8 | 133.8 | 133.8 | 133.8 | 133.8 | 2.7 | 2.7 | 2.4 | 17.02 | 0.3 | 0.09 |
| " $CO_2 8N_2$ | 6.7 | 6.7 | 6.7 | 6.7 | 6.7 | 0.3 | 0.3 | 0.2 | 1.42 | 0.1 | 0.03 |
| " $C_2$ | 52.8 | 52.8 | 52.8 | 52.8 | 52.8 | 5.7 | 5.7 | 3.3 | 23.40 | 2.4 | 0.75 |
| " $C_3$ | 46.6 | 46.6 | 46.6 | 46.6 | 46.6 | 16.4 | 16.4 | 4.4 | 31.20 | 12.0 | 3.76 |
| " $IC_4$ | 11.1 | 11.1 | 11.1 | 11.1 | 11.1 | 9.0 | 9.0 | 1.2 | 8.51 | 7.8 | 2.44 |
| " $NC_4$ | 13.4 | 13.4 | 13.4 | 13.4 | 13.4 | 15.5 | 15.5 | 1.4 | 9.93 | 14.1 | 4.42 |
| " $IC_5$ | 1.5 | 1.5 | 1.5 | 1.5 | 1.5 | 4.3 | 4.3 | 0.2 | 1.42 | 4.1 | 1.28 |
| " $NC_5$ | 1.6 | 1.6 | 1.6 | 1.6 | 1.6 | 5.9 | 5.9 | 0.2 | 1.42 | 5.7 | 1.78 |
| " $C_{6+}$ | 9.8 | 9.8 | 9.8 | 9.8 | 9.8 | 273.5 | 273.5 | 0.8 | 5.67 | 272.7 | 85.43 |

TABLE 3-continued

| | | | | | | | | | |
|---|---|---|---|---|---|---|---|---|---|
| " $H_2O$ | 0.3 | 0.3 | 0.3 | 0.3 | 0.3 | TRACE | TRACE | TRACE | TRACE |
| TOTAL | 277.6 | 277.6 | 277.6 | 277.6 | 277.6 | 333.3 | 333.3 | 14.1 | 319.2 |
| MLB/DAY | 8.6 | 8.6 | 8.6 | 8.6 | 8.6 | 37.6 | 37.6 | 0.6 | 37.0 |
| TEMPERATURE | 100 | 170 | 170 | 304 | 161 | 100 | 65 | 75 | 75 |
| PRESSURE PSIG | 35 | 85 | 270 | 815 | 810 | 35 | 30 | 0 | 0 |
| ENTHALPY MMBTU/DAY | 1.262 | 1.524 | 1.453 | 1.93 | 1.080 | 0.374 | −0.262 | .078 | −0.094 |
| PHASE | VAPOR | VAPOR | VAPOR | VAPOR | MIXED | LIQUID | LIQUID | VAPOR | LIQUID |
| VAPOR | | | | | | | | | |
| MSCF/DAY | 105.4 | 105.4 | 105.4 | 105.4 | 96.6 | | | 5.4 | |
| MACF/DAY | 32.7 | 18.2 | 5.9 | 2.4 | 1.5 | | | 5.4 | |
| LB/CF $T_fP_f$ | 0.26 | 0.47 | 1.4 | 3.6 | 4.8 | | | 0.11 | |
| HEATING VALUE BTU/SCF | | | | | | | | 2342 | |
| LIQUID | | | | | | | | | |
| GAL/DAY 60° F. | | | | | 256.5 | 6111.5 | 6111.5 | | 5967.0 |
| GAL/DAY $T_fP_f$ | | | | | 302.3 | 6262.7 | 6128.7 | | 6020.1 |
| SP GR. $T_fP_f$ | | | | | 0.465 | 0.722 | 0.738 | | 0.739 |
| API 60° F. | | | | | | | | | 57.9 |

Table 4 is the same system as Table 2 where the staging separator is replaced with a stripper column.

TABLE 4

| Description | STREAM 1C WELL HEAD GAS | % | 2C CHOKE INLET | 3C CHOKE OUTLET | 4C CHOKE OUTLET W/RECYCLE | 5C HEATER OUTLET | 6C PRODUCT NATURAL GAS | % | 7C H.P. SEPARATOR LIQUID | 8C H.P. LIQUID TO STRIPPER |
|---|---|---|---|---|---|---|---|---|---|---|
| Moles/Day | | | | | | | | | | |
| " $C_1$ | 10070.5 | 80.90 | 10070.5 | 10070.5 | 10213.0 | 10213.0 | 10070.1 | 82.97 | 142.5 | 142.5 |
| " $CO_28N_2$ | 278.8 | 2.24 | 278.8 | 278.8 | 286.2 | 286.2 | 278.7 | 2.30 | 7.4 | 7.4 |
| " $C_2$ | 1103.1 | 8.86 | 1103.1 | 1103.1 | 1163.6 | 1163.6 | 1102.2 | 9.08 | 61.2 | 61.2 |
| " $C_3$ | 463.0 | 3.72 | 463.0 | 463.0 | 519.6 | 519.6 | 452.8 | 3.73 | 66.6 | 66.6 |
| " $IC_4$ | 82.4 | 0.66 | 82.4 | 82.4 | 97.3 | 97.3 | 75.7 | 0.62 | 21.6 | 21.6 |
| " $NC_4$ | 93.3 | 0.75 | 93.3 | 93.3 | 112.5 | 112.5 | 81.1 | 0.67 | 31.4 | 31.4 |
| " $IC_5$ | 12.1 | 0.10 | 12.1 | 12.1 | 14.7 | 14.7 | 8.3 | 0.07 | 6.4 | 6.4 |
| " $NC_5$ | 14.0 | 0.11 | 14.0 | 14.0 | 16.9 | 16.9 | 8.6 | 0.07 | 8.3 | 8.3 |
| " $C_{6+}$ | 326.2 | 2.62 | 326.2 | 326.2 | 346.6 | 346.6 | 54.3 | 0.45 | 292.3 | 292.3 |
| " $H_2O$ | 4.8 | 0.04 | 4.8 | 4.8 | 5.2 | 5.2 | 4.9 | 0.04 | 0.3 | 0.3 |
| TOTAL | 12448.2 | | 12448.2 | 12448.2 | 12775.5 | 12775.5 | 12137.6 | | 637.9 | 637.9 |
| MLB/DAY | 278.4 | | 278.4 | 278.4 | 289.4 | 289.4 | 241.6 | | 47.8 | 47.8 |
| TEMPERATURE °F. | 76.5 | | 104.5 | 51.3 | 60.3 | 85 | 85 | | 85 | 171.3 |
| PRESSURE PSIG | 2150 | | 2140 | 810 | 810 | 800 | 800 | | 800 | 795 |
| ENTHALPY MMBTU/DAY | −2.378 | | 4.022 | 4.022 | 6.313 | 11.431 | 11.269 | | 0.1629 | 2.566 |
| PHASE | MIXED | | MIXED | MIXED | MIXED | MIXED | VAPOR | | LIQUID | LIQUID |
| VAPOR | | | | | | | | | | |
| MSCF/DAY | 4425.5 | | 4496.6 | 4424.8 | 4538.0 | 4605.9 | 4605.9 | | | 27.9 |
| MACF/DAY | 20.8 | | 24.0 | 62.3 | 65.5 | 72.7 | 72.7 | | | 0.5 |
| LB/CF $T_fP_f$ | 11.4 | | 10.2 | 3.6 | 3.6 | 3.3 | 3.3 | | | 3.3 |
| HEATING VALUE BTU/SCF | | | | | | | 1160 | | | |
| LIQUID | | | | | | | | | | |
| GAL/DAY 60° F. | 8537.8 | | 6976.9 | 10177.4 | 10561.0 | 8825.4 | (1.664 GAL/ MSCF) | | 8825.4 | 8266.9 |
| GAL/DAY $T_fP_f$ | 7808.0 | | 6858.4 | 9899.8 | 10384.0 | 8932.8 | | | 8932.8 | 9157.4 |
| SP GR. $T_fP_f$ API 60° | 0.611 | | 0.597 | 0.640 | 0.634 | 0.641 | | | 0.641 | 0.603 |

| Description | STREAM 9C WATER DRAW | 10C STRIPPER OVERHEAD | 11C 2nd STAGE SUCTION | 12C 3rd STAGE SUCTION | 13C RECYCLE GAS | 14C STRIPPER BOTTOM | 15C CONDEN-SATE TO TANK | 16C CONDEN-TANK VAPOR | 17C CONDEN-SATE | |
|---|---|---|---|---|---|---|---|---|---|---|
| Moles/Day | | | | | | | | | | |
| " $C_1$ | NEGL. | 142.5 | 142.5 | 142.5 | 142.5 | 0 | 0 | NONE | 0 | |
| " $CO_28N_2$ | | 7.4 | 7.4 | 7.4 | 7.4 | 0 | 0 | | 0 | |
| " $C_2$ | | 60.5 | 60.5 | 60.5 | 60.5 | 0.7 | 0.7 | | 0.7 | 0.22 |
| " $C_3$ | | 56.6 | 56.6 | 56.6 | 56.6 | 10.0 | 10.0 | | 10.0 | 3.21 |
| " $IC_4$ | | 14.9 | 14.9 | 14.9 | 14.9 | 6.7 | 6.7 | | 6.7 | 2.16 |
| " $NC_4$ | | 19.2 | 19.2 | 19.2 | 19.2 | 12.2 | 12.2 | | 12.2 | 3.93 |
| " $IC_5$ | | 2.6 | 2.6 | 2.6 | 2.6 | 3.8 | 3.8 | | 3.8 | 1.22 |
| " $NC_5$ | | 2.9 | 2.9 | 2.9 | 2.9 | 5.4 | 5.4 | | 5.4 | 1.74 |
| " $C_{6+}$ | | 20.4 | 20.4 | 20.4 | 20.4 | 271.9 | 271.9 | | 271.9 | 87.53 |

TABLE 4-continued

| | | | | | | | | |
|---|---|---|---|---|---|---|---|---|
| " $H_2O$ | 0.3 | 0.3 | 0.3 | 0.3 | TRACE | TRACE | | TRACE |
| TOTAL | 327.3 | 327.3 | 327.3 | 327.3 | 310.6 | 310.6 | | 310.6 |
| MLB/DAY | 11.0 | 11.0 | 11.0 | 11.0 | | | | |
| TEMPERATURE °F. | 125.6 | 170 | 170 | 274.7 | 223.4 | 100 | | 75 |
| PRESSURE PSIG | 35 | 91 | 285 | 815 | 35.6 | 30.6 | | 0 |
| ENTHALPY MMBTU/DAY | 1.811 | 2.011 | 1.803 | 2.296 | 2.750 | 0.347 | | −0.101 |
| PHASE | VAPOR | VAPOR | MIXED 1 | VAPOR | LIQUID | LIQUID | | LIQUID |
| VAPOR | | | | | | | | |
| MSCF/DAY | 124.1 | 124.1 | 119.8 | 124.2 | | | NONE | |
| MACF/DAY | 40.3 | 20.0 | 6.3 | 6.5 | | | | |
| LB/CF $T_fP_f$ | 0.27 | 0.55 | 1.6 | 4.4 | | | | |
| HEATING VALUE BTU/SCF | | | | | | | | |
| LIQUID | | | | | | | | |
| GAL/DAY 60° F. | | | 154.5 1 | | 5872.6 | 5872.6 | | 5872.6 |
| GAL/DAY $T_fP_f$ | | | 172.7 | | 6551.9 | 6011.3 | | 5924.1 |
| SP GR. $T_fP_f$ | | | 0.578 | | 0.672 | 0.732 | | 0.743 |
| API 60° F. | | | | | | | | 57.0 |

As can be seen, the normal production unit performance from Table 2 yielded 4507.0 M SCFD a natural gas with a high heating value (HHV) of 1148 BTU/SCF and 5502.2 gallon per day (gal/day) of condensate with an estimated Ried Vapor Pressure (RVP) of 20 psi. The vapor loss from the condensate tanks was 109.3 MSCFD with a heating value of 1892 BTU/SCF. The production unit has a heater duty of 13.0 MM BTU/day.

By comparison, the results from the use of a system-two employing an intermediate pressure separator (Table 3) should yield 4597.5 MSCFD of natural gas with a heating value of 1157 BTU/SCF and 5967.0 gal/day of condensate with a RVP of 20 psi. The vapor loss from the condensate tank is reduced to 5.4 MSCFD with a heating value of 2342 BTU/SCF. The heater duty is slightly reduced to 12.6 MM BTU/day and a compressor requirement of 21 brake horsepower (bhp) is added.

The results using a system employing a stripper unit, (Table 4) should yield 4605.9 MSCFD of natural gas at 1159 BTU/SCF. The condensate yield is 5872.6 gal/-day with RVP of 12 psi. There is no vapor loss from the tank. The heater duty is reduced to 11.5 MM BTU/day and the compressor requirement is 24 bhp. The stripper reboiler adds a heater requirement of 2.0 MM BTU/-day.

The foregoing process simulations give an accurate analysis of the operation of the present invention. Since the condensate tank can accept or reject heat from and to the atmosphere, the tank was simulated as an isothermal flash occurring at 75° F. This temperature is a reasonable estimate given the daily and seasonal climate variations and the results therefore represent an annual average. In warm weather the condensate tank will operate hotter than 75° F. and more vapor will be lost. The reverse is true if the tank is cooler than 75° F.

The economics of the two embodiments described are compared against the standard production unit in Table 5. For these economics, natural gas is valued at $3.39/MSCF based on a heating value of a 1000 BTU/SCF (equivalent value $3.39/MM BTU). Condensate is valued at $29.50 per barrel (0.07 per gallon). Gas fired heater duties are assumed to be 80 percent efficient based on the fuels gas high heat value (HHV). This high heat efficiency assumes the use of the Engineered Concepts Automatic Secondary Air Shutter which is capable of maintaining combustion efficiency greater than 90 percent based on the gas low heat value (LHV) (80 percent based on the HHV).

The compressor used in the compression stages is assumed to have a gas engine drive requiring 8000 BTU(LHV)/bhp hr. This energy requirement is equivalent to 8850 BTU(HHV)/bhp hr or 0.212 MM BTU(HHV)/bhp day.

As can be seen on Table 5, the two separator unit recovers an increment of gas worth $492 per day and an increased condensate yield worth $326 per day. The addition operating costs are $11 per day for a total net income increase of $807 per day or $294,555 per year (365 days).

The production unit with the stripper recovers an increment of gas worth $556 per day and an increased condensate yield $260 per day. The addition operating costs an $19 per day for a total net income increase of $797 per day or $290,905 per year. While the overall hydrocarbon recovery is higher for this unit, the net income in this case could be less than for a system employing two separator units. This is due to the current prices which values the gas at $3.39 per million BTU and $29.50 per barrel for condensate which is roughly equivalent to $5.60 per million BTU for the stable condensate. The stripper unit increases the gas recovery at the expense of condensates. Both the normal production unit and the two separator unit system yield a condensate with a RVP of 20 psi after the vapor is lost from the tank. The production unit with the stripper is simulated to produce a condensate with a true vapor pressure of 12.7 psi at 100° F. equal to a RVP of 12. This is done so that the unit can be installed at high altitude and produce a stable condensate with essentially no vapor loss from the condensate tank. Once installed, the stripper can be adjusted to produce a higher vapor pressure product to suit local conditions and still limit vapor loss. This, of course, will increase the condensate yield. The stable condensate from the unit with the stripper has a higher than normal value to the refiner or end user due to its composition. Depending on the prevailing prices for condensate, it may be possible to obtain even greater economic advantages from the use of this invention. The additional income per year for production unit with the stripper will equal the additional income of the two separator unit if the value of the condensate is incrementally increased. Both embodiments therefore offer the possibility of greater income.

TABLE 5

ECONOMIC COMPARISON

| CASE | STANDARD PRODUCTION UNIT | TWO SEPARATOR UNIT at 20° RUP | SEPARATOR WITH STRIPPER 12° RVP |
|---|---|---|---|
| INCOME | | | |
| Natural Gas Rate MSCFD | 4507.0 | 4597.5 | 4605. |
| Heating Value | 1148 | 1157 | 1159 |
| MM Btu/day | 5174.0 | 5319.3 | 5338. |
| Income at $3.39/mm Btu | $17,540 | 18,032 | $18,096 |
| Incremental Income/day | BASE | $492 | $556 |
| Condensate gal/day | 5505 | 5967 | 5873 |
| Income/day at $.70/gal | $3,851 | $4,177 | $4,111 |
| Incremental Income/day | BASE | $326 | $260 |
| OPERATING COST | | | |
| Heater Duty mm Btu/day | 13.0 | 12.6 | 11. |
| Cost/day at $3.39/mm Btu and 80% Eff. | $55 | $53 | $49 |
| Incremental Cost/day | BASE | $−2 | $06 |
| Reboiler Duty mm Btu/day | NONE | NONE | 2. |
| Cost/Day at $3.39 mm Btu. and 80% eff. | | | $8 |

TABLE 5-continued

| CASE | STANDARD PRODUCTION UNIT | TWO SEPARATOR UNIT at 20° RUP | SEPARATOR WITH STRIPPER 12° RVP |
|---|---|---|---|
| ECONOMIC COMPARISON | | | |
| Incremental Cost/day | BASE | NONE | $8 |
| Compressor bhp | NONE | 21.0 | 24. |
| Required mm Btu/day | | 4.4 | 5. |
| Cost/Day at $3.39 mm Btu | | $13 | $17 |
| Incremental Cost/Day | BASE | $13 | $17 |
| SUMMARY OF INCREMENTAL INCOME AND COSTS | | | |
| Income | | | |
| Natural Gas | BASE | $492 | $556 |
| Condensate | BASE | $326 | $260 |
| TOTAL INCREMENTAL INCOME | BASE | $818 | $816 |
| INCREMENTAL OPERATING COSTS | | | |
| Heater | BASE | $−2 | $−6 |
| Reboiler | BASE | | $8 |
| Compressor | BASE | $13 | $17 |
| TOTAL INCREMENTAL OPERATING COST | | $11 | $19 |
| Additional income per day (Income Less Operating Costs) | | $807 | $797 |
| Additional income per year (365 days) | | $294,555 | $290,905 |

By comparison, Table 6, which is keyed to the process schematic shown in FIGS. 6 and 6A, simulates the use of a staging separator operated at 100° F. and 35 psig. with a reboiler for the necessary heat but without compression and recycle to the choke outlet, which is an important characteristic of the present invention.

A careful analysis of the data shown for the process schematics employing the present invention with the results from the processes shown in Table 2, FIG. 3 and Table 6, FIG. 6, demonstrates that, in addition to the improvement in sales gas yield and quality, the liquid condensate recovery is improved, with an improvement in the composition of the condensate.

TABLE 6

| Description | STREAM 1D WELL HEAD GAS | | 2D CHOKE INLET | 3D CHOKE OUTLET | 4D CHOKE OUTLET W/RECYCLE | 5D HEATER OUTLET | 6D PRODUCT NATURAL GAS | | 7D H.P. SEPARATOR LIQUID | 8D H.P. LIQUID TO COOLER | 9D L.P. SEPARATOR FEED | 10D WATER DRAW |
|---|---|---|---|---|---|---|---|---|---|---|---|---|
| Moles/Day | | % | | | | | | % | | | | |
| " $C_1$ | 10070.5 | 80.9 | 10070.5 | 10070.5 | | 10070.5 | 9942.6 | 83.72 | 127.9 | 127.9 | 127.9 | — |
| " $CO_28N_2$ | 278.8 | 2.24 | 278.8 | 278.8 | | 278.8 | 272.2 | 2.29 | 6.6 | 6.6 | 6.6 | |
| " $C_2$ | 1103.1 | 8.86 | 1103.1 | 1103.1 | | 1103.1 | 1049.7 | 8.84 | 53.3 | 53.3 | 53.3 | |
| " $C_3$ | 463.0 | 3.72 | 463.0 | 463.0 | | 463.0 | 407.9 | 3.43 | 55.1 | 55.1 | 55.1 | |
| " $IC_4$ | 82.4 | 0.66 | 82.4 | 82.4 | | 82.4 | 65.2 | 0.55 | 17.2 | 17.2 | 17.2 | |
| " $NC_4$ | 93.3 | 0.75 | 93.3 | 93.3 | | 93.3 | 68.8 | 0.58 | 24.5 | 24.5 | 24.5 | |
| " $IC_5$ | 12.4 | 0.10 | 12.1 | 12.1 | | 12.1 | 7.1 | 0.06 | 5.0 | 5.0 | 5.0 | |
| " $NC_5$ | 14.0 | 0.11 | 14.0 | 14.0 | | 14.0 | 7.4 | 0.06 | 6.6 | 6.6 | 6.6 | |
| " $C_{6+}$ | 326.2 | 2.62 | 326.2 | 326.2 | | 326.2 | 51.0 | 0.43 | 275.2 | 275.2 | 275.2 | |
| " $H_2O$ | 4.8 | 0.04 | 4.8 | 4.8 | | 4.8 | 4.6 | 0.04 | 0.2 | 0.2 | 0.2 | |
| TOTAL | 12448.2 | | 12448.2 | 12448.2 | | 12448.2 | 11876.5 | | 571.7 | 571.7 | 571.7 | |
| MLB/DAY | 278.4 | | 278.4 | 278.4 | | 278.4 | 234.0 | | 44.4 | 44.4 | 44.4 | |
| TEMPERATURE | 76.5 | | 104.5 | 51.3 | | 85 | 85 | | 85 | 52.3 | 72.9 | |
| PRESSURE PSIG | 2150 | | 2140 | 810 | | 800 | 800 | | 800 | 40.0 | 35 | |
| ENTHALPY MMBTU/DAY | −2.378 | | 4.022 | 4.022 | | 10.637 | 10.511 | | 0.1261 | 0.1261 | 0.7088 | |
| PHASE | MIXED | | MIXED | MIXED | | MIXED | VAPOR | | LIQUID | MIXED | MIXED | |
| VAPOR | | | | | | | | | | | | |
| MSCF/DAY | 4425.5 | | 4496.6 | 4424.8 | | 4507.0 | 4507.0 | | | 80.6 | 87.9 | |
| MACF/DAY | 20.8 | | 24.0 | 62.3 | | 71.5 | 71.5 | | | 20.8 | 26.0 | |
| LB/CF $T_fP_f$ | 11.4 | | 10.2 | 3.62 | | 3.27 | 3.27 | | | 0.266 | 0.249 | |
| HEATING VALUE BTU/SCF | | | | | | | 1148.5 | | | | | |
| LIQUID | | | | | | | | | | | | |
| GAL/DAY 60° F. | 8537.8 | | 6976.9 | 10177.4 | | 8093.9 | (1.517 Gal/ MSCF) | | 8093.9 | 6384.7 | 6169.5 | |
| GAL/DAY $T_fP_f$ | 7808.0 | | 6858.4 | 9899.8 | | 8189.6 | | | 8189.6 | 6351.3 | 6216.6 | |
| SP GR. $T_fP_f$ API 60° F. | 0.611 | | 0.597 | 0.640 | | 0.650 | | | 0.650 | 0.733 | 0.731 | |

| Description | STREAM 11D L.P. SEPARATOR VAPOR | | 12D 2nd STAGE SUCTION | 13D 3rd STAGE SUCTION | 14D COMPRESSOR DISCHARGE | 15D RE-CYCLE GAS | 16D L.P. SEPARATOR LIQUID | 17D CONDENSATE TO TANK | 18D CONDENSATE TANK VAPOR | | 19D CONDENSATE | |
|---|---|---|---|---|---|---|---|---|---|---|---|---|
| Moles/Day | | | | | | | | | | % | | % |
| " $C_1$ | 125.2 | 49.84 | | | | | 2.7 | 2.7 | 2.4 | 19.05 | 0.3 | 0.10 |
| " $CO_28N_2$ | 6.3 | 2.51 | | | | | 0.3 | 0.3 | 0.2 | 1.59 | 0.1 | 0.03 |
| " $C_2$ | 47.9 | 19.07 | | | | | 5.4 | 5.4 | 3.0 | 23.81 | 2.4 | 0.78 |
| " $C_3$ | 40.1 | 15.96 | | | | | 15.0 | 15.0 | 3.7 | 29.37 | 11.3 | 3.67 |
| " $IC_4$ | 9.2 | 3.66 | | | | | 8.0 | 8.0 | 1.0 | 7.94 | 7.0 | 2.27 |
| " $NC_4$ | 11.0 | 4.38 | | | | | 13.5 | 13.5 | 1.1 | 8.73 | 12.4 | 4.03 |
| " $IC_5$ | 1.3 | 0.52 | | | | | 3.7 | 3.7 | 0.1 | 0.79 | 3.6 | 1.17 |
| " $NC_5$ | 1.4 | 0.55 | | | | | 5.2 | 5.2 | 0.1 | 0.79 | 5.1 | 1.66 |
| " $C_{6+}$ | 8.6 | 3.42 | | | | | 266.6 | 266.6 | 1.0 | 7.93 | 265.6 | 86.29 |

TABLE 6-continued

| | | | | | | | | |
|---|---|---|---|---|---|---|---|---|
| " $H_2O$ | 0.2 | 0.08 | NEGL. | NEGL. | NEGL. | | NEGL. | |
| TOTAL | 251.2 | | 320.4 | 320.4 | 320.4 | 12.6 | 320.4 | 307.8 |
| MLB/DAY | 7.6 | | 36.8 | 36.8 | 0.5 | | 36.3 | |
| TEMPERATURE | 100 | | 100 | 67.3 | 75 | | 75 | |
| PRESSURE PSIG | 35 | | 35 | 30 | 0 | | 0 | |
| ENTHALPY MMBTU/DAY | 1.102 | | 0.3560 | −0.2266 | −0.2266 | 0.0852 | −0.0983 | |
| PHASE | VAPOR | | LIQUID | LIQUID | VAPOR | | LIQUID | |
| VAPOR | | | | | | | | |
| MSCF/DAY | 95.3 | | | | 4.8 | | | |
| MACF/DAY | 29.6 | | | | 4.8 | | | |
| LB/CF $T_fP_f$ | 0.256 | | | | 0.106 | | | |
| HEATING VALUE BTU/SCF | 1705.9 | | | | 2287 | | | |
| LIQUID | | | | | | | | |
| GAL/DAY 60° F. | | | 5938.1 | 5938.1 | | | 5810.4 | |
| GAL/DAY $T_fP_f$ | | | 6083.4 | 5962.2 | | | 5861.7 | |
| SP GR. $T_fP_f$ | | | 0.724 | 0.739 | | | 0.741 | |
| API 60° F. | | | | | | | 57.4 | |

Figure 10:
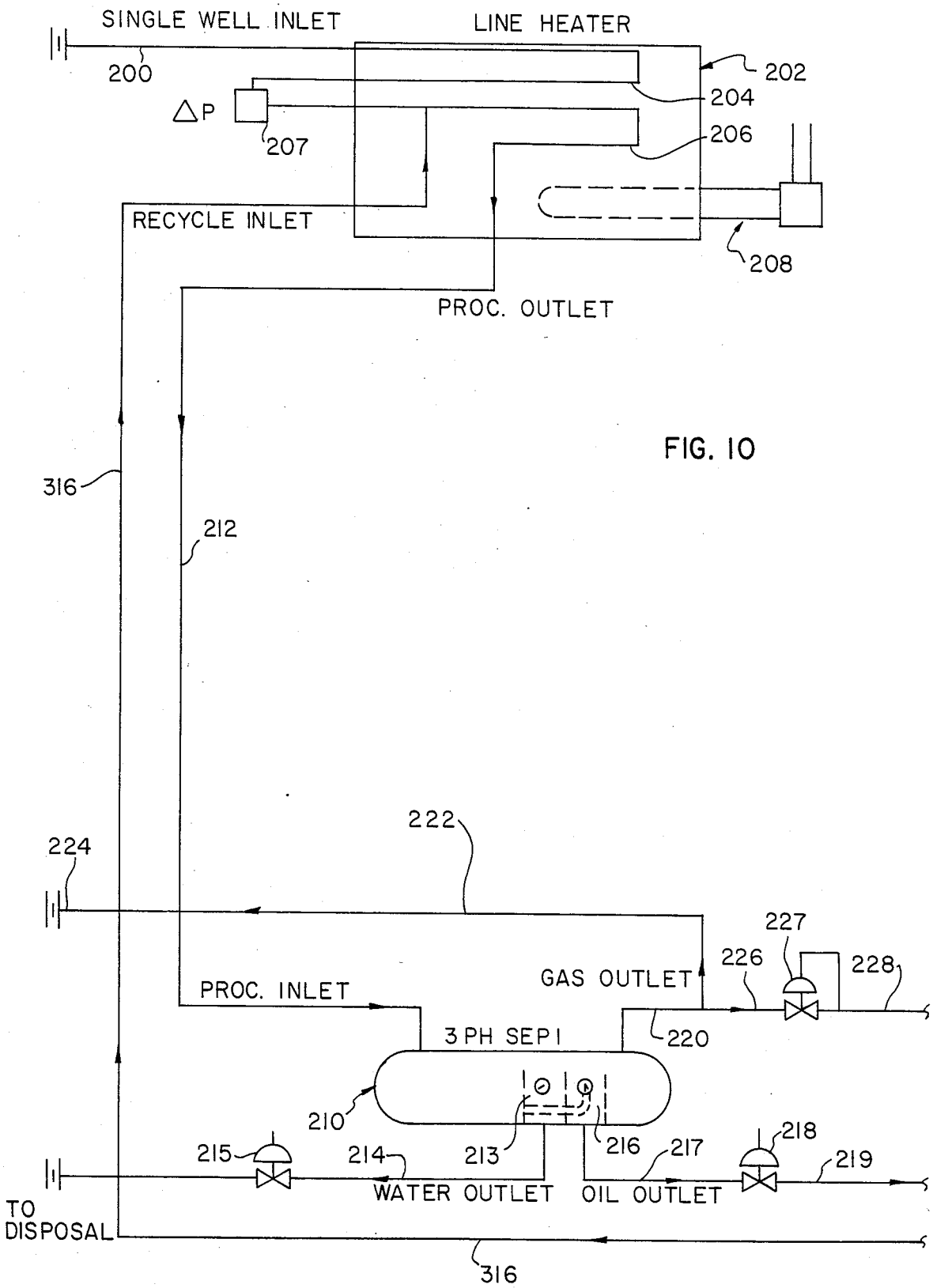
FIGS. 10, 10*a* and 10*b* are schematic drawings of a presently preferred embodiment of the invention.
Figure 10A:
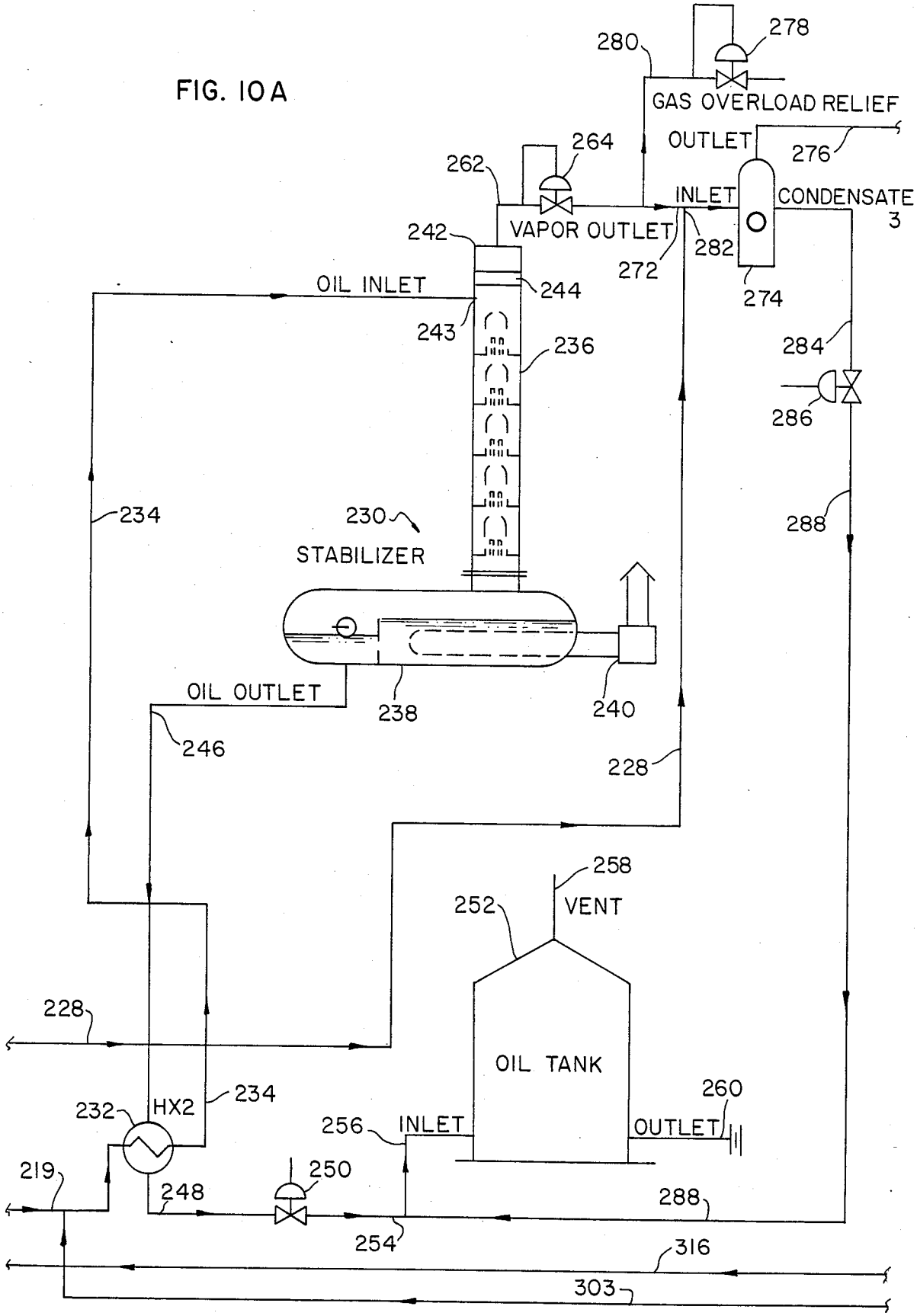
Figure 10B:
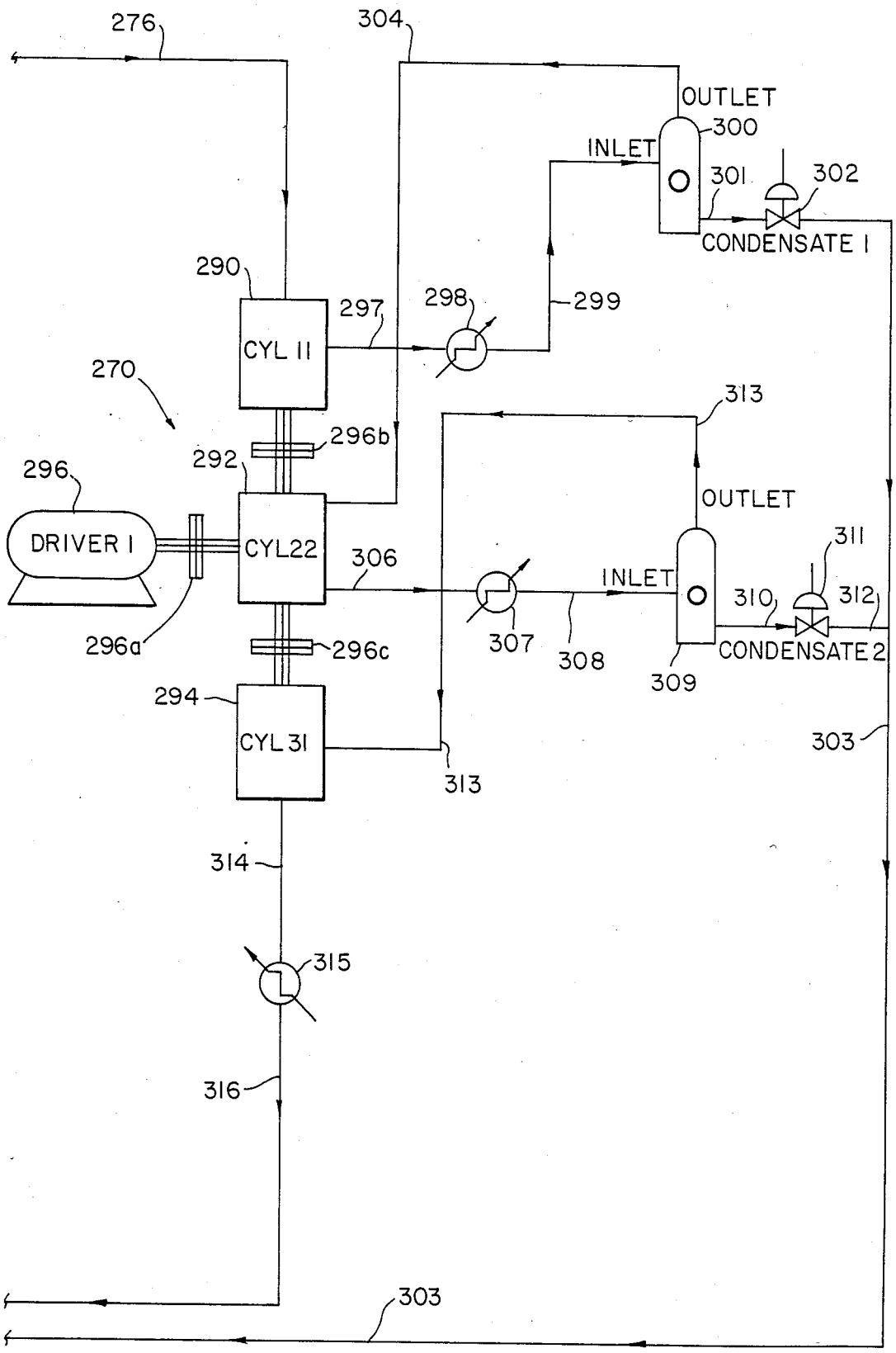

Referring now to FIGS. 10, 10*a* and 10*b*, a single well effluent line 200 is connected to an effluent heating means 202 having a first coil means 204 connected to a second coil means 206 through a choke means 207 and a gas burner means 208 for heating the well effluent to a relatively high temperature at a relatively high pressure prior to delivery to a conventional high pressure three phase primary separator means 210 of the type previously described through a conduit (line or pipe) 212. The heated well effluent delivered to the separator means 210 is processed therein at elevated processing temperatures substantially in excess of gas hydrate formation temperatures and suitable heating means (not shown) may be provided in the separator means to maintain the desired elevated processing temperature of the liquid hydrocarbons delivered thereto. The separation process in separator means 210 removes water from the effluent stream which is collected by suitable collection means 213 and discharged through suitable conduit means 214 including control valve means 215. The separation process also causes removal of heavy end hydrocarbons from the effluent stream which are collected in suitable collection means 216 and discharged through suitable conduit means 217 including flow control valve means 218 to conduit means 219. The separation process provides a body of relatively dry sales gas which is discharged through suitable conduit means 220, 222, to a sales gas outlet line 224. A portion of the sales gas in conduit 220 may be diverted through a conduit means 226 including a flow regulating means 227 to a make-up conduit means 228 for a purpose to be hereinafter described.

As shown in FIG. 10A, the heated liquid body of hydrocarbons (as well as vapor and gaseous constituents therein) collected in primary separator means 210 is delivered to a stripper type secondary separating means 230 through an heat exchanger means 232 and conduit means 234. Stripper means 230 comprises a vertical tray column means 236, a liquid collection tank means 238, and reboiler heating means 240 as previously described. The liquid hydrocarbons from separator means 210 enter the top portion 242 of tray column means 236 at 243 at a reduced pressure sufficient to cause some separation of heavy end hydrocarbon constituents from light end hydrocarbon constituents which form an upwardly flowing gaseous stream. Heavy end portions of the liquid hydrocarbons flow downwardly in tray column means 236 toward tank means 238. Liquid heavy end portions are collected in tank means 238 and are continuously heated by heating means 240 which causes vaporization, release and upward flow of light end hydrocarbon portions in tray column means 236 through downwardly flowing liquid heavy end hydrocarbons. As a result of this conventional process, heated light end hydrocarbons in gaseous or vaporous phase are collected at the top end portion 242 of the tray column means 236 after passing through a suitable demisting screen means 244 while heated liquid heavy end portions are collected in tank means 238 to form a liquid body of heavy end hydrocarbon condensates which is substantially free of light end hydrocarbon constituents. The heated liquid heavy end portions are removed from tank means 238 through suitable conduit means 246, heat exchanger means 232, wherein the temperature of the heavy end condensate is reduced while heating the incoming hydrocarbon liquid from primary separator means 210, and conduit means 248 including suitable conventional flow control valve means 250 for delivery to condensate storage tank means 252 through conduit means 254, 256 at a relatively low temperature and pressure so as to substantially prevent weathering in storage tank means 252 and provide a heavy end condensate product therein at any desired Reid vapor pressure. A suitable conventional vent means 258 and discharge conduit means 260 are associated with tank means 252.

Heated gaseous and vaporous hydrocarbon products at the top portion 242 of tray column means 236 are discharged into conduit means 262, including flow control means 264, for delivery to compressor means 270, FIG. 10B, through a conduit means 272, a conventional separation and condensate collection means 274, and a conduit means 276. A gas overload pressure relief valve means 278 is associated with conduit means 272 through a by-pass conduit means 280. In order to maintain continuous flow in the system, sales gas by-pass conduit means 228 is connected to conduit means 272 at 282 to supply, when required, make-up gas through pressure responsive control valve means 227. Some of the heavy end liquid hydrocarbons may be removed from the stripper gas discharge stream in separator means 274 and delivered to storage tank means 252 through a discharge conduit means 284, a conventional flow control means 286, and a conduit means 288 connected to inlet conduit means 256.

As shown in FIG. 10B, the compressor means 270 comprises first, second and third conventional cylinder-piston compressor units 290, 292, 294 operable by conventional motor means 296 through drive means 296*a*, 296*b* and 296*c*. The recycle stream of hydrocarbons in conduit 276 are delivered to the first compressor unit 290 wherein the hydrocarbons are compressed to raise the temperature and pressure thereof. The compressed hydrocarbons are then delivered through a conduit means 297 to a conventional force-draft air cooler heat exchange means 298 and then through a conduit means 299 to another conventional separation means 300 wherein the temperature of the recycle stream of hydrocarbons is reduced to cause condensation of some of the heavy end hydrocarbons which are collected in liquid form and delivered to conduit 219, FIG. 10A through conduit 301, conventional flow control means 302 and conduit 303 for recycling in stripper means 230. The remaining relatively low pressure gaseous hydrocarbons are delivered to second stage compressor unit 292 through conduit means 304 for compression therein to produce a second recycle stream of high pressure high temperature fluids delivered through a conduit means 306, a conventional force-draft air cooler means 307 and a conduit means 308 to a conventional separation means 309. Condensate collected in separation means 309 is delivered to conduit 303 through conduits 310, a flow control means 311 and a conduit means 312 for recycling through stripper means 230. Remaining gaseous hydrocarbons are delivered to third stage compressor unit 294 through conduit means 313 to increase pressure thereof sufficiently to cause flow through discharge conduit means 314, force-draft air cooler means 315 and conduit means 316 (FIGS. 10, 10A and 10B) to coil means 206 of heater means 202 (FIG. 10) downstream of choke means 207 for mixture with incoming well-head effluent and recycle processing therewith.

Figure 11:
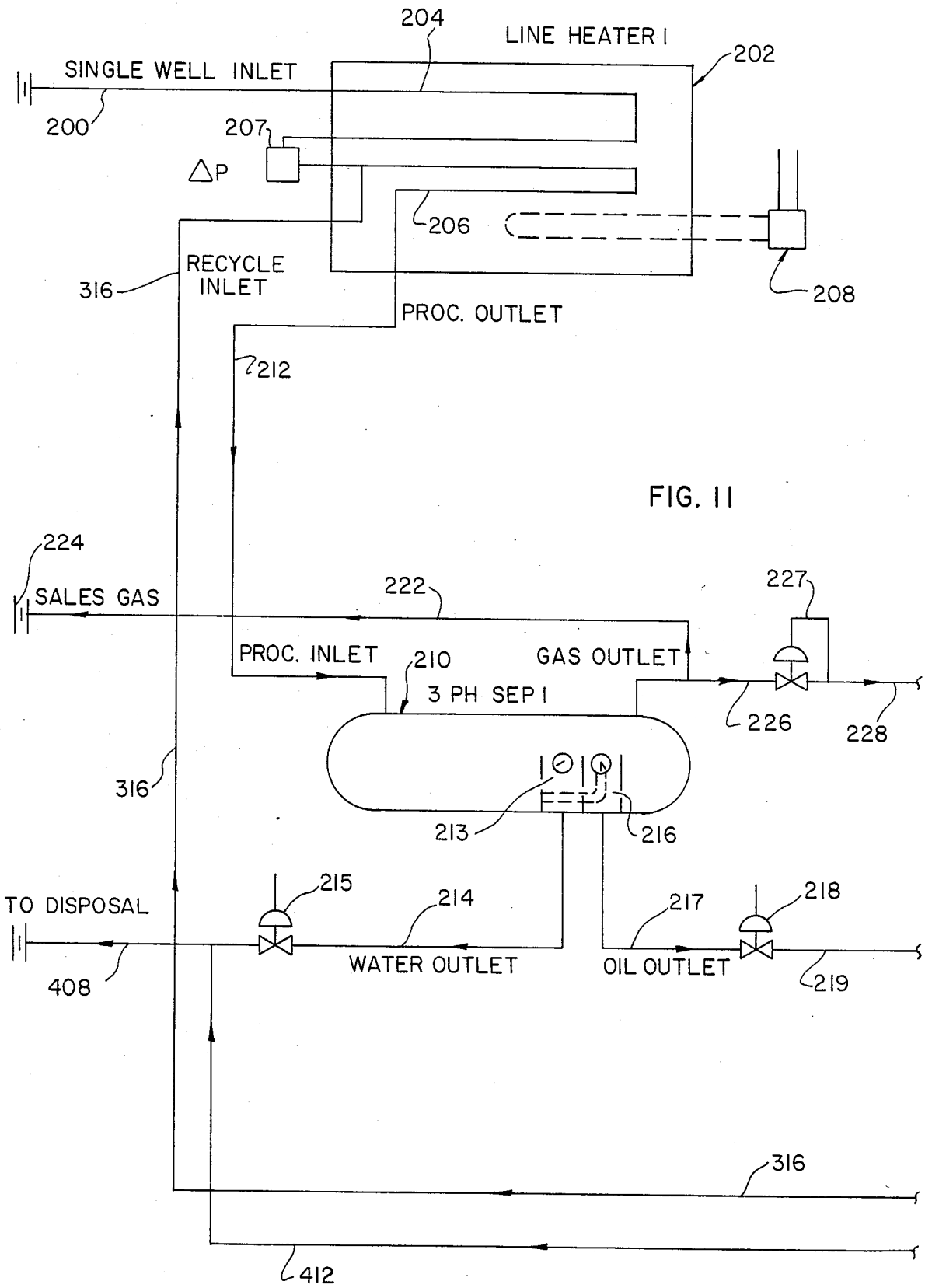
FIGS. 11, 11*a* and 11*b* are a schematic drawing of a modification of the system depicted in FIGS. 10, 10*a* and 10*b*.
Figure 11A:
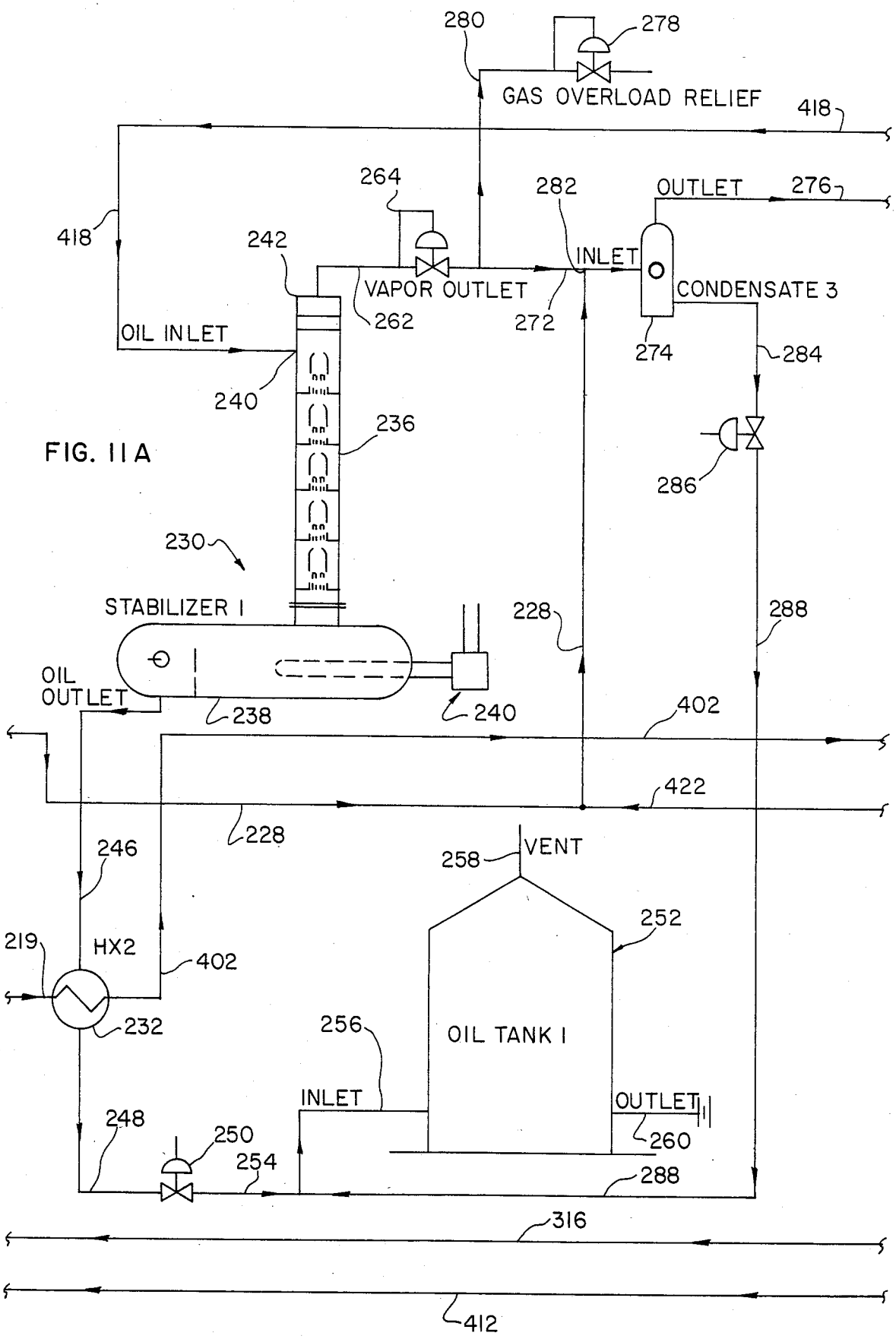
Figure 11B:
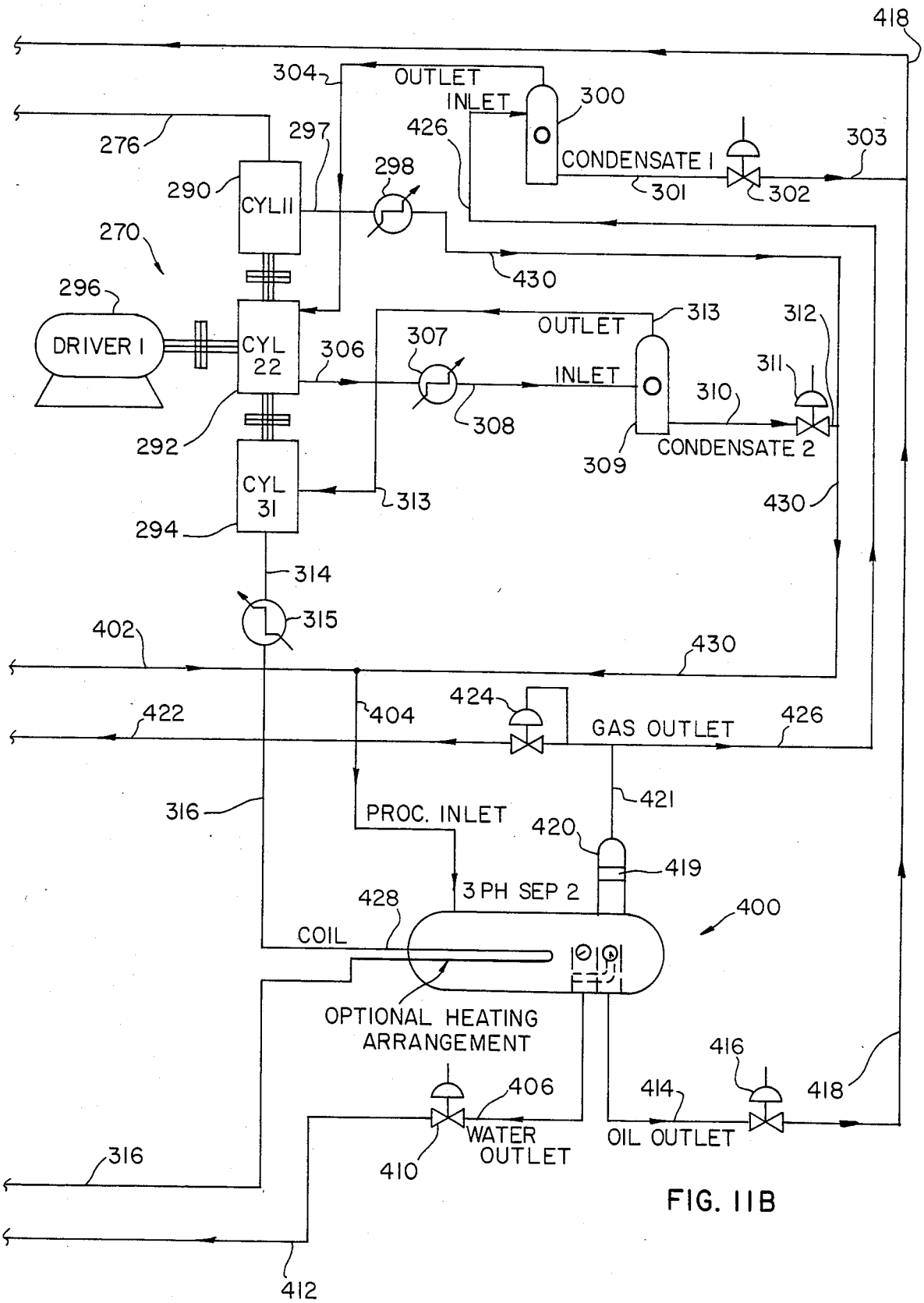

FIGS. 11, 11A and 11B show a modification of the system of FIGS. 10, 10A and 10B wherein an intermediate three-phase intermediate pressure separator 400 is connected in series with the liquid hydrocarbon outlet conduit 217 of primary separator 210 through flow control means 218, conduit 219, heat exchanger means 232 and conduit means 402, 404. Water collected in separator means 400 is removed through conduit means 406 connected to first stage water outlet conduit means 408 through flow control valve means 410 and outlet conduit means 412. Hydrocarbon liquids collected in secondary separator means 400 are removed through conduit means 414 connected to the upper portion 242 of column tray means 236 at 240 through a flow control means 416 and a conduit means 418. Gaseous hydrocarbons collected in separator means 400 flow through a demisting means 419 in a dome portion 420 to gas outlet conduit means 421 connected to make-up conduit means 228 by a conduit means 422 through a back-pressure flow control valve means 424. Gaseous hydrocarbons from separator means 400 are primarily delivered to the compression system through a conduit means 426, conventional condensate separator means 300, and conduit means 304 for processing as previously described. Conduit means 316 from third stage compressor unit 294 may be connected to a heat exchanger coil means 428 in intermediate separator means 400 to maintain a suitable elevated temperature therein.

Another difference between the embodiment of FIGS. 10, 10A and 10B and the embodiment of FIGS. 11, 11A and 11B is that gaseous by-products from stripper separator means 230 are delivered to compressor means 290 through conduit 276 and then, after compression, delivered to intermediate separator means 400 through conduit 297, air cooler pressure reduction means 298 and a conduit means 430 connected to conduit means 404.

In this manner, the liquid hydrocarbon collected in primary separator means 210 is delivered to the intermediate separator means 400 rather than being directly delivered to the stripper separator means 230. After further processing in separator means 400, the remaining liquid hydrocarbons are delivered to the stripper separator means 230 through conduit means 414 and 418. The gaseous hydrocarbons in separator means 400 are normally delivered to the second compressor unit 292 through conduit 426, conventional separator means 300, and conduit 304. Liquid heavy end hydrocarbon condensate collected in separator means 300 is delivered to conduit means 418 through conduit means 301, flow control valve means 302 and conduit means 303 for delivery to stripper means 230. Gaseous hydrocarbons in conduit 304 are compressed in compressor unit 292 and delivered to compressor unit 294 through conduit 306, cooler means 307, conduit 308, conventional condensate separator means 309 and conduit 313. Condensate collected in trap means 309 is delivered to secondary separator means 400 through conduit 310, flow control valve means 311, conduit 312, conduit 430 and conduit 404 for recycling in the secondary separator means 400. Remaining gaseous hydrocarbons are compressed in compressor unit 294 and returned to the inlet heater means through conduit 314, cooler means 315, heater coil means 428, and conduit 316 for recycling with the incoming well stream effluent.

Figure 12:
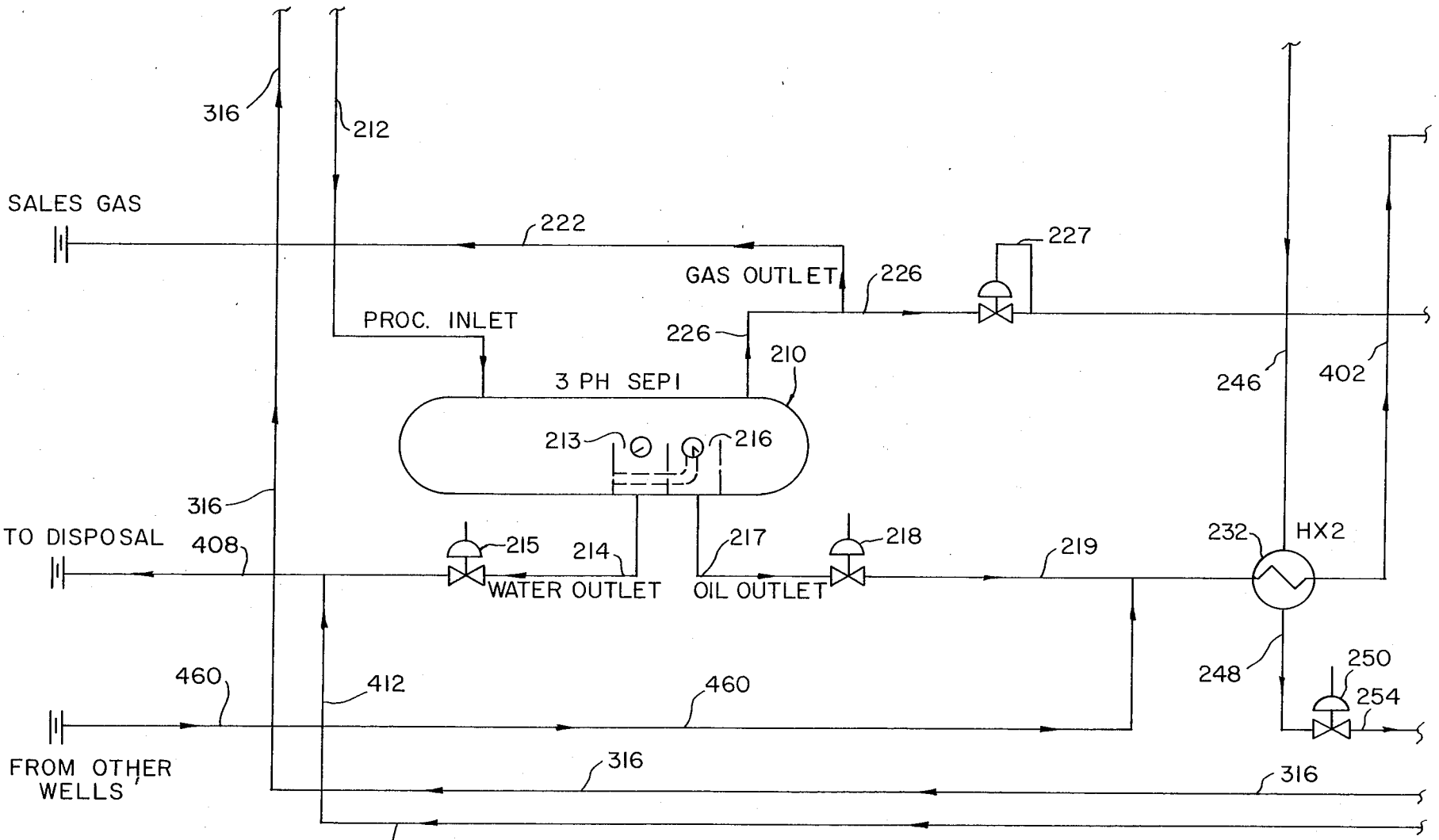
FIG. 12 is a schematic drawing of a modification of the system depicted in FIGS. 11, 11*a* and 11*b*.

FIG. 12 shows a modification of the embodiment of FIGS. 11, 11A and 11B wherein unrecycled liquid hydrocarbons from conventional separating systems of other wells (not shown) may be removed from a first stage high pressure separator and delivered to a conduit 460 connected to conduit 219 downstream of separator 210 for mixing with liquid hydrocarbons from separator 210 and delivery to secondary separator 400 through heat exchanger means 232, conduit 402 and conduit 404 for processing as shown in FIGS. 11A and 11B.

The terms, gaseous hydrocarbon hydrate temperature and the like, as used herein, are known terms of art which mean a relatively low temperature at which gaseous hydrocarbons form a porous solid. This solid is crystallized in a cubic structure in which gas molecules are "trapped" in cavities. Hydrates are capable of blocking flow of gaseous hydrocarbons in a processing system. The formation of such hydrates is a function of the kind of hydrocarbon, associated free water and pressure and temperature conditions thereof. Exemplary known hydrate temperatures are shown in various prior art publications.

In general, the high pressure primary separator means 20, 108 and 210 of the present invention comprise a vessel (tank) of any size or shape mounted in either a vertical or horizontal attitude and designed and constructed to operate at a relatively high pressure (e.g., from about 200 psig to 2000 psig or higher) and at elevated temperatures in excess of process gas hydrate temperatures. Fluids in the vessel are primarily mechanically separated by change of direction of flow, decrease in velocity, scrubbing, etc. in a two-phase (gaseous/liquid separation) or three-phase (gaseous/liquid separation and then water-hydrocarbon liquid separation). Suitable level controls, motor valves, temperature controllers, etc. are utilized to maintain the continuous process conditions.

In general, the stabilizer-type secondary separator means 110, 230 of the present invention requires a heating or reboiler means to indirectly or directly heat the hydrocarbons to an elevated temperature (e.g. 180° F.–250° F.). Direct heating may be effected by a fire-tube means immersed in a liquid body of hydrocarbons collected in a sump (tank) means. Indirect heating may be effected by heating another fluid medium and transferring heat to the process from the fluid medium through a heat exchange means. A vertical column means either packed or trayed with bubble-cap or valve means is required. The lower portion of the vertical column means is insulated and the upper portion is not insulated so as to provide a heat reduction zone to effect condensation and a separation zone to effect separation of liquid hydrocarbons from the gaseous hydrocarbons prior to discharge from the column.

In general, the intermediate state separator means 400 of the present invention comprise a vessel (tank) of any size or shape mounted in either a horizontal or vertical attitude and designed and constructed to operate at a pressure less than the high pressure primary separator means but greater than the lowest separation pressure of any other separation means of the system such as the stabilizer-type secondary separation means. Fluids are mechanically separated in two or three-phase type operation and fluid heating means may or may not be employed. Suitable level controls, motor valves, temperature controllers, etc. are utilized to maintain the continuous process conditions. An intermediate stage separator may be a flash-type separator.

The construction of apparatus and utilization of methods of processing natural gas wellhead effluent at the well site requires consideration of a multitude of factors which are unique to variable conditions at the wellhead site. First, many wellhead sites are located in remote areas where there are no on-site operating personnel and which are not readily accessible by remotely located operating personnel. Second, many wellhead sites are located in geographical areas subject to extreme changes in climatic conditions from a winter period with ice, snow and extremely low temperature conditions (e.g., 32° F. to −50° F.) to a summer period with extremely high temperature conditions (e.g., 90° F. to 120° F.). Thus, while environmental conditions may be controlled at central processing and production plants, environmental conditions at a natural gas wellhead site are generally uncontrollable and processing and production equipment at the wellhead site are subject to extreme environmental conditions without constant availability of on-site maintenance and operating service personnel. Thus, an important consideration feature and object of the present invention is to provide reliable, substantially maintenance free and service free production apparatus and methods which are usable at a wellhead site. Some types of oil-gas production apparatus and methods which may be satisfactorily operated in a controlled environment at a central production facility cannot be reliably operated at a wellhead site. Thus, the design of on-site wellhead production equipment and processes requires consideration of many factors which are not applicable to central production facilities.

The aforedescribed apparatus, methods and systems may be variously employed to achieve the advantages, objectives and results provided by the present invention.

It is to be understood that the system of the present invention is constructed and arranged to operate at variable elevated processing temperatures substantially in excess of the freezing point of water (i.e., 32° F.) and above the hydrate formation temperature of natural gas and variable elevated processing pressures substantially in excess of 20 psig. While normal operating process pressures and temperatures may vary and be controllably varied from well site to well site due to variations in pressures and temperatures of wellhead effluent and flowing line pressures at various well sites, the primary separator means will be typically operated at pressures in the range of 400 psig to 1200 psig and temperatures in the range of 70° F. to 120° F.; the stripper means will be typically operated at pressures in the range of 20 psig to 35 psig and temperatures in the range of 200° F. to 250° F.; the intermediate separator means will be typically operated at pressures in the range of 100 psig to 250 psig and temperatures in the range of 75° F. to 150° F.; the effluent heating means will be typically operated at pressures in the range of 400 psig to 10,000 psig and temperatures in the range of 70° F. to 190° F.; and the compressor means will be typically operated at pressures of 15 psig to 1200 psig and temperatures in the range of 40° F. to 130° F. Thus, the terms "elevated" and "substantially elevated" as used in the specification and claims hereof are intended to be given an interpretation consistent with the foregoing general description.

The terms "flash" or "flashing" as used herein will be understood to mean the release and formation of hydrocarbon gases and vapors from liquid hydrocarbons by reduction in pressure or heating of liquid hydrocarbons. The term "stripping" as used herein will be understood to mean the separation and removal of heavy end hydrocarbons from light end hydrocarbons in gaseous or vaporous phase and/or the separation and removal of gaseous or vaporous light end hydrocarbons from heavy end hydrocarbons in liquid phase. For example, in the "stabilizer" means of the present invention, the pressure of the incoming liquid hydrocarbons is reduced at the inlet to cause removal and separation of some of the light end hydrocarbons by "flashing". In addition, the body of essentially heavy end liquid hydrocarbons collected in the tank at the bottom of the "stabilizer" means is heated to cause residual light end hydrocarbons to be removed and separated therefrom by "flashing". The heated gaseous and vaporous essentially light end hydrocarbons rise through the tray column and pass through the downwardly flowing essentially heavy end liquid hydrocarbons. Residual light end hydrocarbons in the downwardly flowing essentially heavy end liquid hydrocarbons are "stripped" therefrom by the upwardly flowing gaseous and vaporous essentially light end hydrocarbons; and residual heavy end hydrocarbons in the upwardly flowing gaseous and vaporous essentially light end hydrocarbons are "stripped" away by the downwardly flowing essentially heavy end liquid hydrocarbons. The stripping actions are a result of the effects of temperature changes as the temperature of the downwardly flowing essentially heavy end liquid hydrocarbons is gradually increased while the temperature of the upwardly flowing essentially light end gaseous and vaporous hydrocarbons is gradually decreased; and counterflow of one through the other. Increase in temperature of the liquid essentially heavy end hydrocarbons causes release of light end hydrocarbons while decrease in temperature of the essentially light end gaseous and vaporous hydrocarbons causes release of heavy end hydrocarbons. Also, when the essentially heavy end liquid hydrocarbons are delivered to the storage tank means, reduction in pressure causes flashing of residual light end components in the storage tank means unless stabilized to vapor pressure less than atmospheric. The term "weathering" as used herein will be understood to mean the release of residual light end hydrocarbons from the heavy and liquid condensate in the storage tank means. It will be further understood, that the processes of flashing, stripping and weathering inevitably result in a variable mixture of both light end and heavy end hydrocarbons in either the gaseous, vaporous or liquid phases because the processes cause greater or lesser amounts of each to be carried away with the other.

It will be further understood that in some instances, the pressure and/or temperature of the wellhead gas stream may be such as to not require the use of pressure controlling means and/or heating means prior to processing in the high pressure separator means of the present invention.

One of the main advantages of the present invention is that the BTU content of the sales gas may be controlled by varying the process parameters to attain an equilibrium condition of partial vapor pressures for varying the amount of light end hydrocarbons in the sales gas to provide an increased BTU content within a selected BTU content range. Another main advantage is that the vapor pressure of the residual heavy end liquid condensate may be also controlled by temperature and pressure changes to obtain a specified relatively low vapor pressure of the heavy end liquid condensate in the storage tank. A further major advantage is the reduction of loss of hydrocarbons by continuous recycling of the residual gaseous and vaporous hydrocarbons and the residual liquid hydrocarbons without loss to the atmosphere.

It is intended that the appended claims be construed to include alternative embodiments of the invention except insofar as limited by the prior art.

What is claimed is:

1. A high temperature system for improving the volumetric and BTU content yield of wellhead sales gas obtained from a natural gas well at the wellhead site by the use of multiple stages of gas-liquid separation and gas and vapor compression comprising:

heating means for heating the wellhead gas to a predetermined elevated temperature in excess of natural gas hydrate formation temperatures;

valve means associated with said heating means for reducing the pressure of the heated wellhead gases in said heating means to a predetermined reduced pressure to produce reduced pressure wellhead gases at elevated temperatures in excess of natural gas hydrate formation temperatures;

mixing means for mixing the reduced pressure well head gases with compressed gases and vapors at elevated temperatures in excess of natural gas hydrate formation temperatures which have been subjected to multiple stages of compression in the system;

first high pressure gas-liquid separation means for separating gases and vapors from liquids in the heated, reduced pressure wellhead gases and vapors that have been mixed with compressed gases while maintaining elevated temperatures in excess of natural gas hydrate formation temperatures;

second high temperature gas-liquid separation means for further separation of heated gases and vapors from the heated liquid separated by the high pressure gas-liquid separation means to produce heated flashed gases, vapors and liquid components; and gas compression means for compressing the heated gases and vaporized components recovered from said second high temperature gas-liquid separation means and introducing said heated compressed gases and vaporized components into the reduced pressure wellhead gases in said mixing means for recycling in the system without venting to the atmosphere.

2. The system of claim 1 wherein heat exchanging means are provided between the compressed gases and vapors exhausted from the second gas-liquid separation means and the liquids exhausted from the high pressure gas-liquid separation means.

3. The system of claim 1 wherein conduit means are provided between the high pressure gas liquid separation means and the compression means.

4. The system of claim 1 wherein said compression means comprises multiple stages of compression with intercooling between the stages of compression to further separate gaseous and vaporous hydrocarbon components from liquid hydrocarbon components.

5. A high temperature system for improving the volumetric yield and BTU content of sales gas from a stream of wellhead gas by the use of multiple stages of gas-liquid separation with subsequent compression comprising:

heating means for heating a stream of wellhead gas to a predetermined temperature in excess of natural gas hydrate formation temperatures;

valve means for reducing the pressure of the stream of wellhead gas while maintaining a temperature in excess of natural gas hydrate formation temperatures;

means for delivering and mixing heated compressed gases and vapors subsequently recovered from the liquids separated from the wellhead gas into the reduced pressure wellhead gas stream;

first high pressure gas separation means for receiving and separating the heated mixed wellhead gas and compressed gases and vapors container therein from liquids to form liquid hydrocarbon condensates at a preselected relatively high pressure and temperature in excess of natural gas hydrate formation temperatures;

second separator means for receiving separated liquid hydrocarbon condensates from the high pressure gas separation means at a lower delivery pressure than said high pressure gas separation means to further separate dissolved gases and vapors and water from liquid hydrocarbon condensates at a temperature in excess of natural gas hydrate formation temperatures; and compression means for compressing the gases and vapors separated by said second separator means for return thereof into said stream of wellhead gas for recycling in the system.

6. The system of claim 5 including heat exchanging means in the second separator means for receiving the compressed gases and vapors and capable of removing a predetermined amount of heat for operation of the second separator means before introducing the compressed gases and vapors into the stream of wellhead gas.

7. A high temperature system for increasing the volume and enhancing the hydrocarbon composition of a stream of wellhead gas by the use of multiple stages of gas-liquid separation with subsequent compression comprising:

heating means for heating a stream of wellhead gas to a predetermined temperature;

valve means in the wellhead gas stream for reducing the pressure of the heated stream of wellhead gas while maintaining an elevated temperature in excess of natural gas hydrate formation temperatures;

mixing means for mixing high temperature high pressure compressed gases and vapors with the reduced pressure wellhead gas stream;

high pressure gas separation means for receiving the mixed wellhead gas stream and separating gas and vapors from liquid condensates at predetermined elevated relatively high pressures and temperatures in excess of natural gas hydrate formation temperatures to produce liquid hydrocarbon condensates;

stripping means for receiving the liquid condensates from the high pressure gas separation means at lower delivery pressures than said high pressure gas separation means to further separate gases and vapors from the liquid hydrocarbon condensates at temperatures in excess of natural gas hydrate formation temperatures; and compression means for compressing the gases and vapors separated by said stripping means for return thereof into said stream of wellhead gas for recycling through the system.

8. The system of claim 7 wherein said stripping means comprises trayed stripping column means for enabling vertical downward flow of liquid hydrocarbon condensates to a reboiler means for heating liquid hydrocarbon condensates in a tank means for collecting stripped liquid hydrocarbon condensates.

9. The system of claim 8 wherein said compression means includes cooling means for producing additional liquid hydrocarbons and conduit means for delivery of said additional hydrocarbons into said stripping means for recycling therein.

10. A high temperature method of separating absorbed gases and high vapor pressure hydrocarbon components from condensed liquid hydrocarbon components produced from a natural gas wellhead stream comprising the steps of:

maintaining the wellhead gas stream at an elevated temperature in excess of natural gas hydrate formation temperatures;

maintaining the pressure of the wellhead gas stream at a relatively high pressure suitable for separation of gaseous and vaporous hydrocarbon components from liquid hydrocarbon components;

mixing the heated wellhead gas stream with compressed gases and vapors recovered from condensed hydrocarbon liquids subsequently separated from the wellhead gas stream;

separating gaseous and vaporous hydrocarbon components from liquid hydrocarbon components in the wellhead gas stream at a relatively high pressure and temperature in excess of natural gas hydrate formation temperature to provide a body of condensed liquid hydrocarbon components and a sales gas stream;

recovering the separated body of condensed liquid hydrocarbon components and flashing off volatile components contained therein at predetermined elevated temperatures in excess of natural gas hydrate formation temperatures and at pressures lower than the pressures employed during initial separation of the gaseous and vaporous hydrocarbon components from hydrocarbon liquid components;

recovering the flashed gaseous and vaporous hydrocarbon components;

compressing the flashed gaseous and vaporous hydrocarbon components to increase the pressure thereof; and introducing compressed gaseous and vaporous hydrocarbon components into the wellhead gas stream for recycling therewith.

11. A high temperature system for improving the yield of sales gas and liquid hydrocarbon condensates recovered from a natural gas well by the use of multiple stages of gas-liquid separation and gas and vapor compression comprising:

heating means for heating the wellhead gas to a predetermined elevated temperature in excess of natural gas hydrate formation temperatures;

pressure reduction means associated with said heating means for reducing the pressure to a suitable processing pressure while maintaining an elevated temperature of the wellhead gases in excess of gas hydrate formation temperatures to produce a processable stream of wellhead gases;

mixing means for mixing the processable stream of wellhead gases with subsequently recovered compressed hydocarbon gases and vapors which have been subject to compression;

first high pressure gas-liquid separation means operable at temperatures in excess of gas hydrate formation temperatures for receiving the processable stream of wellhead gases and the subsequently recovered compressed hydrocarbon gases and vapors and for separating gases and vapors from liquids to provide a stream of sales quality gas and a first body of liquid hydrocarbon condensates;

second gas-liquid separation means for receiving the first body of liquid hydrocarbon components and being operable at temperatures in excess of gas hydrate formation temperatures for further separation of hydrocarbon gases and vapors from the first body of liquid hydrocarbon condensates to produce additional hydrocarbon gases and vapors from the first body of liquid hydrocarbon condensates and a second body of liquid hydrocarbon components; and compression means for receiving and compressing the additional hydrocarbon gases and vapors prior to delivery to said mixing means for recycling with the stream of wellhead gases.

12. The system of claim 11 and further comprising:

heat exchanging means associated with said additional hydrocarbon gases and vapors for removing additional liquid hydrocarbons from the compressed additional hydrocarbon gases and vapors prior to delivery to said mixing means; and conduit means for recovering and recycling the additional liquid hydrocarbons.

13. The system of claim 12 wherein said compression means provides multiple stages of compression and said heat exchanging means provides intercooling between the stages of compression.

14. A high temperature system for improving the yield of sales gases and liquid hydrocarbon condensate recovered from a stream of wellhead gas by the use of multiple stages of hydrocarbon gas-liquid separation with subsequent compression comprising:

heating means for providing a stream of wellhead gas at an elevated temperature in excess of natural gas hydrate formation temperatures;

pressure controling means for controlling the pressure of the stream of wellhead gas while maintaining an elevated temperature of the stream of wellhead gas to provide a processable stream of wellhead gas suitable for processing to provide sales gas and liquid hydrocarbon condensate;

first high pressure gas separation means for receiving and processing the processable stream of wellhead gas at a suitable elevated temperature in excess of natural gas hydrate formation temperatures and a suitable elevated pressure to provide sales gas and liquid hydrocarbon condensates;

second separator means for receiving the liquid hydrocarbon condensates from the first high pressure gas separation means at a suitable elevated temperature in excess of natural gas hydrate formation temperatures and a suitable lower pressure than the pressure in said first high pressure gas separation means and for separating dissolved and high vapor pressure gases and vapors and water retained in the liquid hydrocarbon condensate at elevated temperatures in excess of natural gas hydrate formation temperatures to provide a stream of additional hydrocarbon gases and vapors;

compression means for receiving and compressing the additional gases and vapors;

conduit means for delivering the compressed additional gases and vapors to said first high pressure gas separation means for reprocessing therein with the processable stream of wellhead gases; and liquid hydrocarbon condensate recovery means for receiving and collecting all liquid hydrocarbon condensates produced in the system.

15. An high temperature processing system for increasing the volume and B.T.U. content of natural sales gas recovered from a stream of wellhead gas and for increasing the yield of liquid hydrocarbon condensate by the use of multiple stages of gas-liquid separation with subsequent compression comprising:

first high pressure hydrocarbon gas-liquid separation means for receiving a stream of wellhead gas and being operable at suitable high pressures and temperatures in excess of natural gas hydrate formation temperatures to produce sales gas and liquid hydrocarbons;

stripping means for receiving liquid hydrocarbons from the first high pressure hydrocarbon gas-liquid separation means and for processing the liquid hydrocarbons at an elevated temperature in excess of natural gas hydrate formation temperatures to separate dissolved and high vapor pressure gases and vapors and water from the liquid condensate and to provide a stream of additional hydrocarbon gases and vapors and a body of residual liquid hydrocarbons;

compression means for receiving and compressing the additional gases and vapors to provide a stream of recyclable gases and vapors;

conduit means for returning the recyclable gases and vapors to the first high pressure separation means for reprocessing therein; and condensate storage means for receiving and storing all liquid hydrocarbon condensates produced by the system.

16. The apparatus of claim 15 wherein said stripping means comprises trayed stripping column means for producing a vertical downward flow of liquid hydrocarbons to a collection tank means for collecting liquid hydrocarbons and reboiler means for heating liquid hydrocarbons in said collection tank means.

17. The apparatus of claim 16 and further comprising:

cooling means for producing additional liquid hydrocarbons from the compressed gases and vapors from said compression means; and conduit means for delivering the additional liquid hydrocarbons into the stripping means for recycling therein.

18. A high temperature method of separating absorbed gases, vapor and liquid hydrocarbon components from liquids separated from a stream of natural wellhead gas during processing thereof comprising the steps of:

controlling the pressure and temperature of the stream of wellhead gas to provide a controlled temperature and pressure processable wellhead stream of natural gas having predetermined relatively high pressures and temperatures in excess of natural gas hydrate temperatures suitable for further processing;

initially separating liquids from the controlled temperature and pressure processable wellhead stream of natural gas while maintaining a relatively high pressure and temperature in excess of natural gas hydrate temperatures during separation thereof to provide a stream of sales quality gas and a body of liquid hydrocarbons;

further processing the body of liquid hydrocarbons and flashing the volatile hydrocarbon components from the liquid hydrocarbons to produce additional flashed gaseous and vaporous components and to produce a residual body of liquid hydrocarbons at substantially atmospheric temperature and pressure lower than the temperature and pressure employed during initial high temperature high pressure separation of the liquids;

recovering the additional flashed gaseous and vaporous components from the body of liquid hydrocarbons;

compressing the additional flashed gaseous and vaporous components to a predetermined pressure and then cooling the compressed flashed gaseous and vaporous components to recover additional liquid hydrocarbons and recycling the additional liquid hydrocarbons; and returning the remaining compressed additional gaseous and vaporous components to the processable wellhead stream of natural gas.

19. The method as defined in claim 18 and wherein:

all residual gaseous hydrocarbon components produced in the system are recycled in the system and all liquid hydrocarbons produced in the system are subject to sequential processing steps to produce a final liquid body of heavy end hydrocarbons which is substantially free of light end hydrocarbons while also increasing the volume and BTU content of sales gas without substantial loss of light end hydrocarbons.

20. A system for processing natural gas wellhead effluent at the wellhead site to provide a sales gas stream which is composed primarily of only gaseous light end hydrocarbon constituents by removal of water constituents and heavy end hydrocarbon constituents in the natural gas wellhead effluent comprising:

a wellhead effluent inlet conduit means for delivering the wellhead effluent to the system;

a wellhead effluent heating means associated with said wellhead inlet conduit means for heating the wellhead effluent to produce a heated stream of wellhead effluent;

a wellhead effluent pressure control means for controlling the pressure of the heated wellhead effluent stream;

primary stage high pressure separator means for receiving all of the heated well effluent stream and for maintaining the heated well effluent stream at a suitable elevated processing temperature and pressure while separating the well effluent by pressure reduction into a natural gas stream of sales quality comprising primarily light end hydrocarbons, a liquid body of water and an heated liquid body of residual heavy end hydrocarbons held in said high pressure separator means at an elevated temperature and pressure and containing residual light end hydrocarbons in gaseous and vaporous phases;

sales gas line means connected to said primary stage high pressure separator means for removing said natural gas stream therefrom;

secondary stage separator means for receiving the heated liquid body of heavy end hydrocarbons including the residual light end hydrocarbons contained therein and for separating residual light end hydrocarbons from heavy end hydrocarbons and forming a heated gaseous stream of residual hydrocarbons comprising primarily light end hydrocarbons having an elevated temperature and pressure and a liquid body of heated residual hydrocarbons comprising primarily heavy end hydrocarbons in said secondary stage separate means;

second heating means associated with said secondary stage separator means for continuously heating said liquid body of hydrocarbons and causing vaporization and removal of substantially all light end hydrocarbons therein to provide a residual heated liquid body of substantially only heavy end hydrocarbon condensate and driving vaporized hydrocarbons into said heated gaseous stream of residual hydrocarbons produced in said secondary stage separator means;

condensate storage tank means for receiving the residual liquid body of heavy end condensate from said secondary stage separator means and holding said residual liquid body of heavy end condensate at substantially atmospheric pressures and temperatures and relatively low vaporization pressure;

conduit means for delivering residual liquid heavy end condensate from said secondary stage separator means to said storage tank means including temperature and pressure reducing means for reducing the temperature and pressure of the residual liquid heavy end condensate delivered to said condensate storage tank means;

compression means for receiving the heated residual light end hydrocarbon gaseous stream from said secondary stage separator means and for compressing the heated residual light end hydrocarbon gaseous stream to raise the pressure and temperature thereof;

separator discharge conduit means for delivering the heated residual light end hydrocarbon gaseous stream from said secondary stage separator means to said compression means including temperature and pressure reducing means for causing condensation of a portion of the residual heavy end hydrocarbons contained therein;

first condensate trap and conduit means associated with said separator discharge conduit means for collecting residual heavy end hydrocarbon condensate and delivering said residual heavy end hydrocarbon condensate to said secondary stage separator means for recycling therein;

compressor discharge conduit means connected to said compression means for receiving the heated compressed gaseous stream of residual hydrocarbons and including temperature and pressure reducing means for causing condensation of another portion of the residual heavy end hydrocarbons in said gaseous stream of residual hydrocarbons;

second condensate trap and conduit means associated with said compressor discharge conduit means for collecting residual heavy end hydrocarbon condensate and delivering said residual heavy end hydrocarbon condensate to said secondary stage separator means for recycling therein;

said compressor discharge conduit means being connected to said wellhead effluent conduit means downstream of said choke means for delivering the remaining portion of said heated gaseous stream of residual hydrocarbons to said wellhead effluent conduit means for mixing with the wellhead effluent stream and recycling through the system; and the construction and arrangement of the system being such as to continuously recycle residual hydrocarbons and remove substantially all light end hydrocarbons from the system only through said sales gas line and remove substantially all heavy end hydrocarbons from the system only through said condensate storage tank means while maintaining all hydrocarbons in said system at an elevated temperature during the processing cycle.

21. The invention as defined in claim 20 and wherein said effluent heating means comprises:

heating tank means for containing a fluid heating medium;

a first heating coil means in said tank means for receiving and heating the well effluent;

a choke means downstream of said first heating coil means for reducing the pressure of said well effluent; and a second heating coil means in said heating tank means downstream of said choke means for maintaining said well effluent at a predetermined elevated temperature prior to delivery to said primary separation means.

22. The invention as defined in claim 21 and wherein said residual gaseous hydrocarbon conduit means connecting said compression means to said effluent heating means downstream of said choke means and upstream of said second heating coil means.

23. The invention as defined in claim 20 and wherein said secondary separation means comprising:

a tray column means for establishing a vertical downward flow of liquid hydrocarbons;

an horizontal tank means at the bottom of said tray column means for collecting liquid hydrocarbons;

a gas burner means connected to said heat tube means for supplying heat thereto.

24. The invention as defined in claim 20 and further comprising:

an intermediate stage separator means for receiving all residual liquid hydrocarbon condensates from said primary stage separator means and for delivering residual liquid hydrocarbons collected therein to said final stage separator means.

25. The invention as defined in claim 24 and wherein said compression means comprising:

a plurality of compressor units;

a first compressor unit being constructed and arranged to receive said residual hydrocarbon gas stream from said final stage spearation means; and a second compressor unit being constructed and arranged to receive said residual hydrocarbon gas stream from said first compressor unit.

26. The invention as defined in claim 20 and wherein said compression means comprising:

a first compressor unit adapted to receive a first residual hydrocarbon gas stream from said final stage separator means and deliver said compressed residual hydrocarbon gas stream to said intermediate stage separator means;

a second compressor unit adapted to receive a second residual hydrocarbon gas stream from said intermediate stage separator means; and a third compressor unit for receiving said second residual hydrocarbon gas stream from said second compressor unit and for delivering said second residual gas stream to said well effluent inlet conduit means.

27. The invention as defined in claim 26 and further comprising:

heating coil means located in said intermediate stage separator means and connected to said gaseous conduit means between said third compressor unit and said wellhead effluent inlet conduit means.

28. The invention as defined in claim 20 and further comprising:

a condensate inlet conduit means for receiving first stage hydrocarbon condensate from another separating system associated with another wellhead and being connected to said condensate conduit means between said primary stage separator means and said final stage separator means.

29. A method of continuous treatment of natural gas wellhead effluent at the wellhead for increasing the recovery of sales gas while increasing the stability of hydrocarbon liquid condensate without venting of gaseous constituents to the atmosphere comprising the steps of:

controlling the temperature and pressure of the wellhead effluent by heating and restriction of flow to provide a controlled temperature and pressure processing stream of wellhead effluent having a temperature and pressure suitable for initial separation of gaseous and liquid constituents of the wellhead effluent causing initial separation in high pressure separator apparatus of gaseous light end hydrocarbon constituents and liquid heavy end hydrocarbon condensate constituents and liquid water condensate constituents in the processing stream of natural gas wellhead effluent;

removing the gaseous light end hydrocarbon constituents from the high pressure separator apparatus to provide a stream of sales gas;

collecting the liquid heavy end hydrocarbon condensate constituents in the high pressure separator apparatus;

continuously transferring the liquid heavy end hydrocarbon constituents to stripper apparatus and causing secondary separation of gaseous light end hydrocarbon constituents from liquid heavy end hydrocarbon constituents to provide a secondary stream of gaseous light end hydrocarbon constituents and a secondary body of liquid heavy end hydrocarbon constituents;

continuously heating the body of liquid heavy end hydrocarbon constituents to vaporize substantially all of the light end hydrocarbon constituents and causing the light end hydrocarbon constituents to join the secondary stream of gaseous light end hydrocarbon constituents;

continuously transferring the secondary stream of gaseous hydrocarbon constituents to compressor-separator means and causing separation of gaseous light hydrocarbon ends from heavy liquid hydrocarbon ends;

continuously transferring heavy liquid hydrocarbon ends from said compressor-separator means to said stripper means for recycling therein;

continuously transferring gaseous hydrocarbon constituents from said compressor-separator means to said high pressure separating means for mixing and recycling therein with said controlled temperature and pressure processing stream of natural gas wellhead effluent;

continuously forming and collecting only heavy end liquid hydrocarbon in said stripper means which has substantially all light end hydrocarbons removed therefrom and transferring only the heavy end liquid hydrocarbons at a controlled, relatively low vapor pressure to a storage tank at atmospheric pressure without significant formation or loss of gaseous hydrocarbons;

means for continuously mixing and recycling therein with said controlled temperature and pressure processing stream of natural gas wellhead effluent; and continuously forming and collecting a body of heated liquid hydrocarbons in said stripper means which is at a predetermined temperature and pressure and is substantially free of light end hydrocarbons and which can be delivered to an atmospheric storage tank at a controlled relatively low vapor pressure without formation of any substantial amounts of gaseous light end hydrocarbons under atmospheric temperature and pressure conditions in the storage tank.

30. Apparatus for treating natural gas wellhead effluent, including natural gas and hydrocarbon condensate, to produce dry sales gas and collect hydrocarbon condensate comprising:

a heating means for heating the natural gas wellhead effluent;

a first heating coil means in said heater means for receiving the natural gas wellhead effluent and heating the natural gas wellhead effluent and providing a first heated relatively high pressure natural gas wellhead effluent stream;

a choke means connected to said first heating coil means and being located downstream thereof for reducing the pressure of said first heated relatively high pressure natural gas wellhead effluent stream and providing a second heated relatively low pressure natural gas wellhead effluent stream;

a second heating coil means in said heater means and connected to said first heating coil means through said choke means and being located downstream thereof for receiving said second heated relatively low pressure natural gas wellhead effluent stream and for heating said second heated relatively low pressure natural gas effluent stream and providing a third relatively high temperature high pressure natural gas effluent stream;

a high pressure separator tank means connected to said second heating coil means downstream thereof for receiving said third relatively high temperature high pressure natural gas effluent stream therefrom and for removing heavy end hydrocarbons and forming a liquid body of heavy end hydrocarbons and providing light end hydrocarbon sales gas;

sales gas outlet line means connected to said high pressure separator tank means for receiving sales gas therefrom;

liquid hydrocarbon outlet line means connected to said high pressure separator tank means for receiving the liquid hydrocarbons therefrom;

stripper means connected to said high pressure separator tank means through said liquid hydrocarbon outlet line means for receiving liquid hydrocarbons from said high pressure separator tank means and removing a first substantial portion of entrained light end hydrocarbons therefrom and providing a residual liquid body of primarily heavy liquid hydrocarbon ends with a substantial amount of light end hydrocarbons entrained therein; and reboiler heating means associated with said stripper means for receiving and heating said residual liquid body of hydrocarbons to provide relatively high pressure high temperature residual liquid heavy end condensate.

31. Apparatus for processing effluent discharged from a natural gas well head at the well head site at well head discharge pressures and temperatures, the effluent constituents comprising light end and heavy end hydrocarbons and water in gaseous, liquid and vapor phases, to remove water and heavy end hydrocarbons from the effluent and to provide sales gas containing primarily light end hydrocarbons in a stable gaseous phase and to provide heavy end hydrocarbons in a stable liquid phase without substantial loss of either of the light end hydrocarbons or the heavy end hydrocarbons during processing of the effluent, and the apparatus comprising:

first effluent heating means for heating the effluent to a predetermined, relatively high elevated temperature;

a choke means downstream of said first effluent heating means for receiving the heated effluent from the said first effluent heating means and reducing the pressure of the heated effluent to a predetermined pressure;

a second effluent heating means downstream of said choke means for increasing the temperature of the effluent to a predetermined temperature;

high pressure primary separator tank means downstream of said second effluent heating means for receiving the effluent from said second effluent heating means at an elevated temperature;

separation means in said high pressure primary separator tank means for continuously receiving effluent from said second heating means and for continuously separating the effluent into gaseous light end hydrocarbon constituents of sales gas quality and into liquid water constituents and into residual hydrocarbon constituents including a portion of the light end hydrocarbon components and heavy end hydrocarbon constituents in liquid and vapor phases;

third heating means for continuously receiving and heating said residual hydrocarbon constituents to increase the pressure and temperature thereof;

stripper separator means downstream of said primary separator means for continuously receiving said residual hydrocarbon constituents from said separator tank means at an elevated temperature and pressure;

gaseous discharge means associated with said stripper means for continuously removing gaseous hydrocarbon constituents therefrom to form a gaseous recycle stream composed primarily of light end hydrocarbon constituents with a minority of heavy end hydrocarbon constituents therein;

sump means associated with said stripper means for continuously collecting residual stripped liquid hydrocarbons;

fourth heating means associated with said sump means for continuously heating said residual stripped liquid hydrocarbons to a relatively high temperature to continuously vaporize light end hydrocarbon constituents contained therein and to drive vaporized light end hydrocarbon constituents through said stripper means to said discharge means;

heavy end liquid discharge means associated with said sump means for continuously removing heavy end constituents in liquid phase therefrom at an elevated temperature and pressure;

heavy end liquid storage means maintained at substantially atmospheric temperature and pressure conditions for receiving said heavy end constituents in liquid phase from said heavy end liquid discharge means;

compression means downstream of said gaseous discharge means for continuously receiving said gaseous hydrocarbon constituents therefrom at an elevated temperature and for compressing gaseous hydrocarbon constituents to increase the temperature and to increase the pressure thereof;

separator means downstream of said compression means for reducing the pressure of the compressed gaseous hydrocarbon constituents whereby to separate light end gaseous components from heavy end liquid components;

discharge means connected to said separator means for conveying gaseous light end hydrocarbon components to said second heater means downstream of said choke means and upstream of said second heater means whereby said gaseous light end hydrocarbon components are mixed with said wellhead effluent;

the apparatus being constructed and arranged to continuously maintain temperatures of the wellhead effluent constituents to above hydrate temperatures during the processing cycle.

32. A method of separating a stream of natural gas wellhead effluent into a stream of sales gas and a residual body of liquid hydrocarbons comprising:

controlling the temperature and pressure of the wellhead effluent to provide a separation process compatible effluent process stream at a predetermined elevated pressure and elevated temperature suitable for a subsequent primary pressure-temperature reduction-type separation processing at temperatures in excess of natural gas hydrate formation temperatures;

delivering the separation process compatible effluent process stream to a primary pressure-temperature reduction separation apparatus operable at elevated pressure and elevated temperature conditions in excess of natural gas hydrate formation temperatures;

separating heavy end hydrocarbon constituents and light end hydrocarbon constituent and water constituents in said effluent process stream in said primary pressure-temperature reduction separation apparatus at temperatures in excess of natural gas hydrate formation temperatures and thereby providing a primary stream of gaseous hydrocarbons for sales gas composed primarily of light end hydrocarbons and a primary body of residual liquid hydrocarbons;

discharging the primary stream of gaseous hydrocarbons from the primary pressure-temperature reduction separation apparatus to a sales gas line;

further processing the primary body of residual liquid hydrocarbons produced in said primary pressure-temperature reduction means by transfer to a secondary separation means and producing a secondary stream of residual gaseous hydrocarbons composed primarily of light end hydrocarbons and producing a secondary body of residual liquid hydrocarbons composed primarily of heavy end hydrocarbons;

heating the secondary body of residual liquid hydrocarbons to remove residual light end hydrocarbons and produce a third body of residual liquid hydrocarbon condensate composed substantially only of heavy end hydrocarbons substantially free of light end hydrocarbons and a third stream of residual gaseous hydrocarbons;

delivering the third body of residual liquid hydrocarbon condensate to a storage tank means at substantially atmospheric conditions at a controlled vaporization pressure; and recycling the secondary stream and the third stream of residual gaseous hydrocarbons at temperatures in excess of gas hydrate formation temperature by delivery to and mixing with the wellhead effluent stream.

33. The invention as defined in claim 32 and further comprising:

combining said secondary stream and said third stream of residual gaseous hydrocarbons to provide a recycle stream of gaseous hydrocarbons;

compressing the recycle stream of gaseous hydrocarbons prior to delivery to and mixing with the wellhead effluent to cause further separation of light end hydrocarbons and residual heavy end hydrocarbons contained therein; and recycling the residual heavy end hydrocarbons through the secondary separation means.

34. A high temperature system for increasing the volume and enhancing the hydrocarbon composition of a stream of sales gas produced from a wellhead stream of natural gas containing light end hydrocarbons and heavy end hydrocarbons by the use of multiple stages of gas-liquid separation with subsequent compression comprising:

wellhead gas delivery means for providing a wellhead stream of natural gas at a sufficient relatively high pressure and temperature in excess of natural gas hydrate formation temperatures for processing to produce a stream of essentially light end sales gas;

high pressure gas-liquid separator means for receiving the stream of wellhead gas and for initially separating gas and vapor hydrocarbons from liquid hydrocarbons to produce the stream of essentially light end hydrocarbon sales gas and a body of essentially heavy end liquid hydrocarbons;

flashing and stripping separation means for receiving the liquid hydrocarbons from the high pressure gas-liquid separator means and processing the liquid hydrocarbons therein at a predetermined lower pressure than the pressure in said high pressure gas separation means and at a temperature in excess of natural gas hydrate formation temperatures to further separate hydrocarbon gases and vapors from the liquid hydrocarbons to produce a second body of liquid hydrocarbons composed essentially of heavy end hydrocarbons and a first stream of residual gases and vapors composed essentially of light end hydrocarbons;

compression means for compressing the first stream of residual gases and vapors received from said flashing and stripping separation means to produce additional liquid hydrocarbons composed essentially of heavy end hydrocarbons and a second stream of compressed residual gases and vapors composed essentially of light end hydrocarbons for recycling through the system;

recycling means for delivering the additional liquid hydrocarbons from the compression means to the flashing and stripping separation means for recycling therein and for delivering said second stream of compressed residual gases and vapors to said high pressure gas-liquid separation means for recycling therein to provide additional light end hydrocarbons for the stream of sales gas and to enable recovery of a maximum portion of the heavier end hydrocarbons as a liquid body having a controlled vapor pressure; and storage tank means for receiving said second body of liquid hydrocarbons from said flashing and stripper means at a controlled relatively low vapor pressure.

35. The invention as defined in claim 34 and wherein said compression means comprising:

multiple-stage compression means connected in series for providing multiple stages of compression at increasing pressures; and cooling means for cooling said compressed gases and vapors after compression.

36. The method as defined in claims 34 or 35 and wherein:

said system being constructed and arranged to separate substantially all residual gaseous hydrocarbon components produced in the system from the residual separated hydrocarbon liquids produced in the system and to recycle all residual gaseous hydrocarbon components produced in the system at temperatures in excess of natural hydrate gas formation temperatures and to produce a final liquid body of heavy end hydrocarbons which is substantially free of light end hydrocarbons and has a controlled vapor pressure while also increasing the volume and BTU content of sales gas without substantial loss of any hydrocarbons.

* * * * *